US008684564B2

(12) United States Patent
Shen et al.

(10) Patent No.: US 8,684,564 B2
(45) Date of Patent: Apr. 1, 2014

(54) LIGHT-EMITTING DIODE ILLUMINATION APPARATUSES

(75) Inventors: Yu-Nung Shen, Taipei (TW); Tsung-Chi Wang, Taipei (TW)

(73) Assignees: Yu-Nung Shen, Taipei (TW); Tsung-Chi Wang, Taipei (TW)

( * ) Notice: Subject to any disclaimer, the term of this patent is extended or adjusted under 35 U.S.C. 154(b) by 501 days.

(21) Appl. No.: 12/890,883

(22) Filed: Sep. 27, 2010

(65) Prior Publication Data

US 2011/0074296 A1 Mar. 31, 2011

(30) Foreign Application Priority Data

Sep. 28, 2009 (TW) ..... 98132653 A

(51) Int. Cl.
*F21V 29/00* (2006.01)

(52) U.S. Cl.
USPC ..... 362/294; 362/373; 362/800; 257/714; 257/715; 361/699; 361/701; 361/703

(58) Field of Classification Search
USPC ..... 362/294, 373, 800; 257/714, 715; 361/699, 701, 703
See application file for complete search history.

(56) References Cited

U.S. PATENT DOCUMENTS

2010/0177519 A1* 7/2010 Schlitz ..... 362/294

* cited by examiner

*Primary Examiner* — Stephen F Husar
*Assistant Examiner* — Meghan Dunwiddie
(74) *Attorney, Agent, or Firm* — Jackson IPG PLLC

(57) ABSTRACT

The present invention relates to an LED illumination apparatus. The apparatus includes a body having a lower portion adapted for coupling to a power socket and an upper portion provided with a power source module accommodating chamber. A heat-dissipating module includes a funnel-shaped hollow case disposed at a top end of the upper portion and filled with a coolant fluid, wherein the hollow case has a small diameter open end adjacent to the body and a large diameter open end remote from the body. A light source module includes amounting substrate disposed at the small diameter open end, an LED mounted on the mounting substrate, and a power source module disposed within the power source module accommodating chamber in a manner electrically connected to and supplying working power to the LED.

16 Claims, 33 Drawing Sheets

LIGHT-EMITTING DIODE ILLUMINATION APPARATUSES

BACKGROUND OF THE INVENTION

1. Field of the Invention

The present invention relates to light-emitting diode illumination apparatuses.

2. Description of the Prior Art

As light-emitting diodes (LEDs) are increasingly improved in terms of output power, the waste heat generated thereby is increased proportionally and the dissipation of waste heat becomes much important for high-power LEDs. However, most of the LEDs lamps today are retailed to dissipate heat through heat-dissipating fins and/or cooling fans and heat-conductive pastes. The designs of these types result in coincidence of the light path and the heat transfer path and lead to a phenomenon known as radiative heat transfer. The traditional designs possess a deficiency in dissipation of waste heat, causing serious luminous decay of LEDs and reducing the lifespan of LEDs. All of these factors result in an increased manufacture cost, which is one of the major reasons that the extensive use of LEDs in illumination apparatuses has not prevailed to date.

A useful solution to the problems described above has been proposed by the inventors in R.O.C. Patent Application No. 097146076 filed on Nov. 27, 2008. The inventors now provide another means to solve the problems, which is based on using separate routes for transmitting light and heat.

In view of the above, the inventors have devised light-emitting diode illumination apparatuses to fulfill the needs in this respect.

SUMMARY OF THE INVENTION

Accordingly, an object of the invention is to provide light-emitting diode illumination apparatuses capable of solving the heat dissipation problem which is unable to be solved by the prior art.

In order to achieve this object, a light-emitting diode illumination apparatus according to a technical feature of the invention is provided, which comprises a body having a lower portion adapted for coupling to a commercially available power socket and an upper portion provided with a power source module accommodating chamber; a heat-dissipating module including a funnel-shaped hollow case disposed at a top end of the upper portion of the body and filled with a coolant fluid, wherein the hollow case has a small diameter open end adjacent to the body and a large diameter open end remote from the body and having a greater diameter than that of the small diameter open end; and a light source module including amounting substrate disposed at the small diameter open end, at least one light-emitting diode (LED) operatively mounted on the mounting substrate, and a power source module disposed within the power source module accommodating chamber of the body in a manner electrically connected to and supplying working power to the LED.

According to another technical feature of the invention, an LED illumination apparatus is provided, which comprises a body having a lower portion adapted for coupling to a commercially available power socket and an upper portion provided with a power source module accommodating chamber; a heat-dissipating module including a lamp cover provided at a top end of the upper portion of the body and a coolant fluid filled within the lamp cover; and a light source module including a mounting substrate disposed within the lamp cover, at least one LED operatively mounted on the mounting substrate, and a power source module disposed within the power source module accommodating chamber of the body in a manner electrically connected to and supplying working power to the LED.

According to still another technical feature of the invention, an LED illumination apparatus is provided, which comprises an elongated housing sealed at both ends by respective seal members and composed of a first elongated transparent hollow tube and a second first elongated transparent hollow tube, wherein the first elongated transparent hollow tube has a diameter greater than that of the second elongated transparent hollow tube, and wherein the second tube is disposed within the first tube in an eccentric manner, so that the second transparent tube has an outer surface in contact, in part, with an inner surface of the first transparent tube, thereby defining a coolant fluid accommodating space between an non-contact portion of the outer surface of the second transparent tube and an non-contact portion of the inner surface of the first transparent tube, which is adapted for accommodating a coolant fluid; a reflective plate fixed within the second tube in a manner extending from one end to the other end of the second tube, wherein the reflective plate has a reflective surface arranged to face a surface where the first and second tubes are brought in contact with each other; and a light source module including two mounting substrates each being disposed on an inner surface of a corresponding one of the seal members, at least two LEDs each being mounted on a corresponding one of the mounting substrates, mounting electrodes each extending outwardly from an outer surface of a corresponding one of the seal members and adapted for directly coupling to a commercially available power socket, and a power source module electrically connected to the LEDs and adapted for converting mains power into a usable power source for the LEDs.

According to still another technical feature of the invention, an LED illumination apparatus is provided, which comprises a housing configured as an elongated hollow transparent tube filled with a coolant fluid, the housing having two ends opposite to each other; and a light source module including two mounting substrates each being disposed at one of the two ends of the housing, at least two LEDs each being mounted on a corresponding one of the mounting substrates, mounting electrodes extending outwardly from the two ends of the housing and adapted for directly coupling to a commercially available power socket, and a power source module electrically connected to the LEDs and adapted for converting mains power into a usable power source for the LEDs, wherein the LEDs are mounted such that the LED mounted at one of the two ends of the housing emits light towards the LED mounted at the opposite end of the housing.

According to still another technical feature of the invention, an LED illumination apparatus is provided, which comprises a housing configured as an elongated hollow tube formed with a longitudinally extending elongated opening on its wall, wherein the housing has two ends opposite to each other and a reflective plate is disposed inside of the housing and extends from one end of the housing to the opposite end of the housing, and wherein the reflective plate has a central portion protruded towards the opening, and wherein a power source module accommodating space is defined in the housing at a backside of the reflective plate; and a light source module comprising two longitudinally extending elongated mounting substrates disposed on an inner surface of the housing in a manner facing each other, each having an LED mounting surface facing the protruded central portion of the reflective plate; a plurality of LEDs mounted on the LED mounting surfaces of the mounting substrates; mounting electrodes provided at the two ends of the housing and adapted for directly coupling to a commercially available power socket; and a power source module disposed within the power source module accommodating space of the housing and adapted for converting mains power into a usable power source for the LEDs.

According to still another technical feature of the invention, an LED illumination apparatus is provided, which comprises a housing configured as an elongated hollow tube filled with a coolant fluid; and a light source module comprising a plurality of the mounting substrates disposed on an outer surface of the housing, a plurality of LEDs mounted on the mounting substrates, mounting electrodes extending outwardly from both ends of the housing and adapted for directly coupling to a commercially available power socket, and a power source module electrically connected to the LEDs and adapted for converting mains power into a usable power source for the LEDs.

According to still another technical feature of the invention, an LED illumination apparatus is provided, which comprises a housing configured as a transparent elongated hollow tube filled with a coolant fluid; and a light source module including a mounting substrate extending between two ends of the housing, a plurality of LEDs mounted in an array on the mounting substrate, mounting electrodes extending outwardly from the two ends of the housing and adapted for directly coupling to a commercially available power socket, and a power source module electrically connected to the LEDs and adapted for converting mains power into a usable power source for the LEDs.

According to still another technical feature of the invention, an LED illumination apparatus is provided, which comprises a body having a lower portion adapted for coupling to a commercially available power socket and an upper portion; a heat-dissipating module including at least one heat-dissipating fin set disposed in an array configuration within the upper portion of the body, and at least one heat pipe, wherein the heat-dissipating fin set includes a hollow tubular body and a plurality of heat-dissipating fins radially extending from the hollow tubular body, and wherein the heat pipe is disposed within the body of the heat-dissipating fin set and protruded at both ends thereof from the body of the heat-dissipating fin set; and a light source module comprising a mounting substrate disposed at one end of the upper portion of the body, at least one LED, and a power source module disposed within the body and adapted for converting mains power into a usable power source for the LED, wherein the mounting substrate is formed with a through hole at a position corresponding to the heat pipe, so as to allow the heat pipe to be inserted at its end into the through hole, and wherein the LED is operatively mounted at the one end of the heat pipe that penetrates through the through hole of the mounting substrate.

According to still another technical feature of the invention, an LED illumination apparatus is provided, which comprises a housing configured as an elongated hollow tube formed with a longitudinally extending elongated opening on its wall, a longitudinally extending elongated reflective plate having a generally V-shaped cross-section being disposed inside of the housing, wherein a power source module accommodating space is defined in the housing at a backside of the reflective plate; and a light source module comprising a longitudinally extending elongated mounting substrate disposed on a central portion of the reflective plate, the mounting substrate having two LED mounting surfaces, each facing a corresponding one of two reflective portions extending inclinedly and upwardly from the central portion of the reflective plate; a plurality of LEDs mounted on the LED mounting surfaces of the mounting substrate; mounting electrodes provided at both ends of the housing and adapted for directly coupling to a commercially available power socket; and a power source module disposed within the power source module accommodating space of the housing and adapted for converting mains power into a usable power source for the LEDs.

According to still another technical feature of the invention, an LED illumination apparatus is provided, which comprises a housing configured as an elongated hollow tube formed with a longitudinally extending V-shaped groove on its wall, wherein a coolant fluid accommodating space is defined in the housing at a backside of the groove and used to accommodate a coolant fluid; and a light source module comprising two longitudinally extending elongated mounting substrates disposed back-to-back on a bottom portion of the groove, such that the respective mounting substrates have an LED mounting surface facing a corresponding groove wall of the groove, wherein the light source module further comprises a plurality of LEDs mounted on the LED mounting surfaces of the mounting substrates, mounting electrodes provided at both ends of the housing and adapted for directly coupling to a commercially available power socket, a power source module for converting mains power into a usable power source for the LEDs, and a heat pipe disposed between and in contact with the mounting substrates and extending into the coolant fluid accommodating space.

According to still another technical feature of the invention, an LED illumination apparatus is provided, which comprises a body adapted for coupling to a commercially available power socket and provided with a power source module accommodating chamber, and a lamp cover disposed on an upper portion of the body, wherein the lamp cover includes a coolant fluid accommodating section disposed adjacent to the upper portion of the body, in which a coolant fluid is filled; and a light source module comprising a mounting substrate disposed within the accommodating section of the lamp cover, at least one LED operatively mounted on the mounting substrate, and a power source module disposed within the power source module accommodating chamber of the body and electrically connected to the LED and adapted for converting mains power into a usable power source for the LED.

According to still another technical feature of the invention, an LED illumination apparatus is provided, which comprises a body adapted for coupling to a commercially available power socket and provided with a power source module accommodating chamber, and a lamp cover disposed on an upper portion of the body and filled with a coolant fluid; and a light source module comprising a lead frame disposed within the lamp cover, at least one LED operatively mounted on the lead frame, and a power source module disposed within the power source module accommodating chamber of the body and electrically connected to the LED via the lead frame and adapted for converting mains power into a usable power source for the LED.

According to still another technical feature of the invention, an LED illumination apparatus is provided, which comprises a body adapted for coupling to a commercially available power socket and provided with a power source module accommodating chamber, and a lamp cover disposed on an upper portion of the body and filled with a coolant fluid; and a light source module comprising at least one mounting substrate extending upwardly from the upper portion of the body, at least one LED operatively mounted on the mounting substrate, and a power source module disposed within the power source module accommodating chamber of the body and electrically connected to the LED and adapted for converting mains power into a usable power source for the LED.

According to still another technical feature of the invention, an LED illumination apparatus is provided, which comprises a body adapted for coupling to a commercially available power socket and provided with a power source module accommodating chamber, and a lamp cover disposed on an upper portion of the body and filled with a coolant fluid; and a light source module comprising at least one heat pipe extending upwardly from the upper portion of the body, predetermined circuit traces overlaid on a surface of the heat pipe, at least one LED operatively mounted on the surface of the heat pipe in a manner electrically connected to the predetermined circuit traces, and a power source module disposed within the power source module accommodating chamber of the body and electrically connected to the predetermined circuit traces and adapted for converting mains power into a usable power source for the LED.

According to still another technical feature of the invention, an LED illumination apparatus is provided, which comprises a housing comprising an outer tube and an inner tube sleeved within the outer tube, wherein the outer tube is formed with a longitudinally extending elongated opening and the inner tube is formed with a longitudinally extending protruded portion protruded out through the opening of the outer tube; and a light source module comprising a longitudinally extending elongated bracket disposed within the inner tube at a position near the protruded portion, and a mounting substrate disposed on the bracket at a position between the bracket and the protruded portion, at least one LED operatively mounted on the mounting substrate, mounting electrodes provided at both ends of the housing and adapted for directly coupling to a commercially available power socket, and a power source module for converting mains power into a usable power source for the LED.

According to still another technical feature of the invention, an LED illumination apparatus is provided, which comprises a body adapted for coupling to a commercially available power socket and provided with a power source module accommodating chamber, and a lamp cover disposed at a top end of the body and filled with a coolant fluid; and a light source module comprising a reflective frame disposed within the lamp cover and extending upwardly from the top end of the body, at least one mounting substrate disposed on the reflective frame, at least one LED operatively mounted on the mounting substrates, and a power source module disposed within the power source module accommodating chamber of the body and electrically connected to the LED and adapted for converting mains power into a usable power source for the LED.

According to still another technical feature of the invention, an LED illumination apparatus is provided, which comprises a body adapted for coupling to a commercially available power socket and provided with a power source module accommodating chamber, a lamp cover disposed at a top end of the body, a heat pipe disposed within the lamp cover and extending upwardly from the top end of the body, and a coolant fluid pack disposed within the lamp cover and sleeved around the heat pipe and filled with a coolant fluid; and a light source module comprising a mounting substrate disposed at the top end of the body and within the lamp cover, at least one LED operatively mounted on the mounting substrate, and a power source module disposed within the power source module accommodating chamber of the body and electrically connected to the LED and adapted for converting mains power into a usable power source for the LED.

According to still another technical feature of the invention, an LED illumination apparatus is provided, which comprises a body adapted for coupling to a commercially available power socket and provided with a power source module accommodating chamber, and a lamp cover disposed at a top end of the body and filled with a coolant fluid; a heat-dissipating member disposed within the lamp cover, including a heat-dissipating body disposed at a top end of the body and a plurality of heat-dissipating fins radially extending from the heat-dissipating body; and a light source module comprising a mounting substrate disposed at the top end of the body and within the lamp cover, at least one LED operatively mounted on the mounting substrate, a light diffusing member extending upwardly from the heat-dissipating member and spreading in a sectorial form along a direction away from the LED to thereby scatter the light emitted from the LED out of the lamp cover, and a power source module disposed within the power source module accommodating chamber of the body and electrically connected to the LED and adapted for converting mains power into a usable power source for the LED.

According to yet still another technical feature of the invention, an LED illumination apparatus is provided, which comprises a housing including an upper half cover and a transparent lower half cover and having a rear end adapted for coupling to a lamp holder, so that the housing is fastened to the lamp holder; and a light source module, including: a heat pipe fixed inside of the housing and having a first end portion extending to the rear end of the housing and a second end portion opposite to the first end portion; a mounting substrate disposed at the second end portion of the heat pipe, so that the mounting substrate has a mounting surface facing the lower half cover; at least one LED operatively mounted on the mounting surface of the mounting substrate; a power source module disposed within the housing and electrically connected to the LED and adapted for converting mains power into a usable power source for the LED; and a coolant fluid pack filled with a coolant fluid, which is disposed within the housing and sleeved around the heat pipe.

BRIEF DESCRIPTION OF THE DRAWINGS

The above and other objects, features and effects of the invention will become apparent with reference to the following description of the preferred embodiments taken in conjunction with the accompanying drawings, in which.

DETAILED DESCRIPTION OF THE PREFERRED EMBODIMENTS

Figure 1:
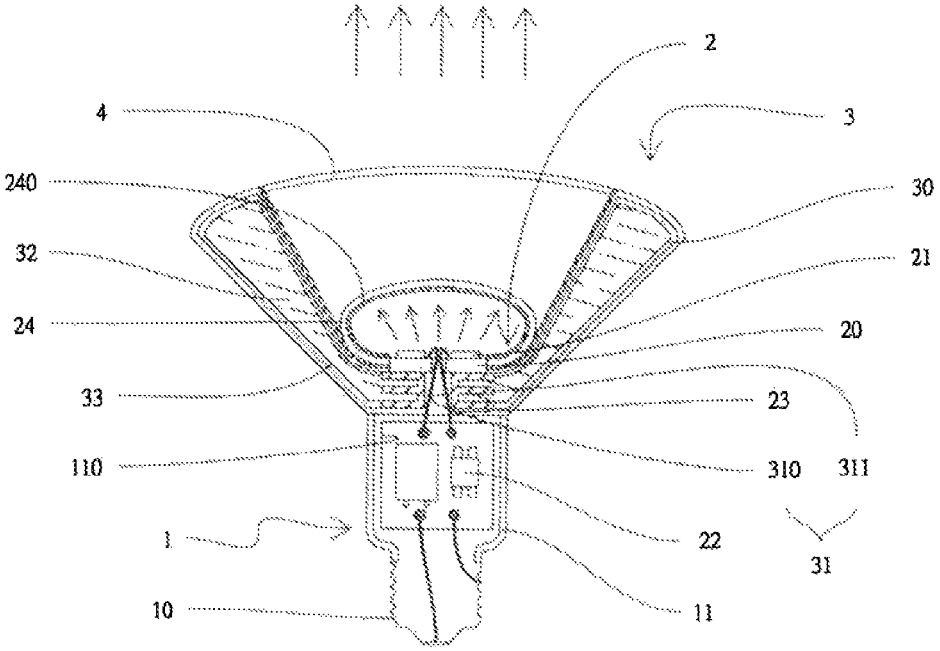
FIG. 1 is a schematic, cross-sectional view of the light-emitting diode illumination apparatus according to the first preferred embodiment of the invention.

Before the present invention is described in greater detail, it should be noted that the same or like elements are denoted by the same reference numerals throughout the disclosure. Moreover, the elements shown in the drawings are not illustrated in actual scale, but are expressly illustrated to explain in an intuitive manner the technical feature of the invention disclosed herein.

FIG. 1 is a schematic, cross-sectional view of the light-emitting diode illumination apparatus according to the first preferred embodiment of the invention.

The LED illumination apparatus shown in FIG. 1 comprises a body 1, a light source module 2 and a heat-dissipating module 3.

According to this embodiment, the body 1 has a lower portion 10 configured in the form of a standard E27-type threaded adapter and an upper portion 11 provided with a power source module accommodating chamber 110.

The heat-dissipating module 3 includes a funnel-shaped hollow case 30 disposed at a top end of the upper portion 11 of the body 1. The hollow case 30 is filled with a coolant fluid 32. The hollow case 30 has a small diameter open end adjacent to the body 1 and a large diameter open end having a greater diameter than that of the small diameter open end.

It should be noted that the large diameter open end of the hollow case 30 can be sealed with a lens 4.

The hollow case 30 is provided at its small diameter open end with a heat-dissipating member 31. The heat-dissipating member 31 includes a heat-dissipating body 310 and a plurality of heat-dissipating fins 311 radially extending from the heat-dissipating body 310 to the case 30 in a manner contacting with coolant fluid 32 filled within the case 30. In this embodiment, the hollow case 30 is made of glass, and the heat-dissipating member 31 is made of material with high thermal conductivity, such as aluminum. On the other hand, the coolant material 32 is optionally loaded within a flexible container 33 made from plastic material, such as polyethylene (PE) or polyethylene terephthalate (PET), so as to avoid occurrence of accident caused by accidental leakage of the coolant fluid 32 due to rupture of the hollow case 30.

The light source module 2 includes a mounting substrate 20 disposed on the heat-dissipating member 31 at a position between the two open ends of the case 30, at least one light-emitting diode (LED) 21 operatively mounted on the mounting substrate 20, and a power source module 22 placed within the power source module accommodating chamber 110 of the body 1. The LED 21 is electrically connected to the power source module 22 via wires 23. It is apparent to those skilled in the art that the LED 21 can be electrically connected to the power source module 22 by any alternative means suitable for establishing electrical connection. The establishment of electrical connection between the power source module 22 and the LED 21 is well-known in the art and is not detailed herein. In addition, the LED 21 is mounted on the mounting substrate 20 by any means suitable for mounting purpose, such as flip-chip bonding, chip-on-board bonding (COB) and the like.

The light source module 2 further comprises a transparent protective shield 24 disposed in a manner covering the mounting substrate 20, so as to provide protection to the LED 21 mounted on the mounting substrate 20. The protective shield 24 is coated on the inner or outer surface thereof with a phosphor powder layer 240.

By virtue of the arrangement described above, the light emitted from the LED 21 will pass through the large diameter open end of the case 30, whereas the heat generated due to operation of the LED 21 is dissipated to the environment through the heat-dissipating member 31 and the coolant fluid 32. The arrangement disclosed herein eliminates coincidence of the light path and the heat transfer path. Taking advantage of the separation of light and heat transmission routes, the arrangement disclosed herein does not generate radiative heat, thereby ameliorating the luminous decay problem.

Figure 2:
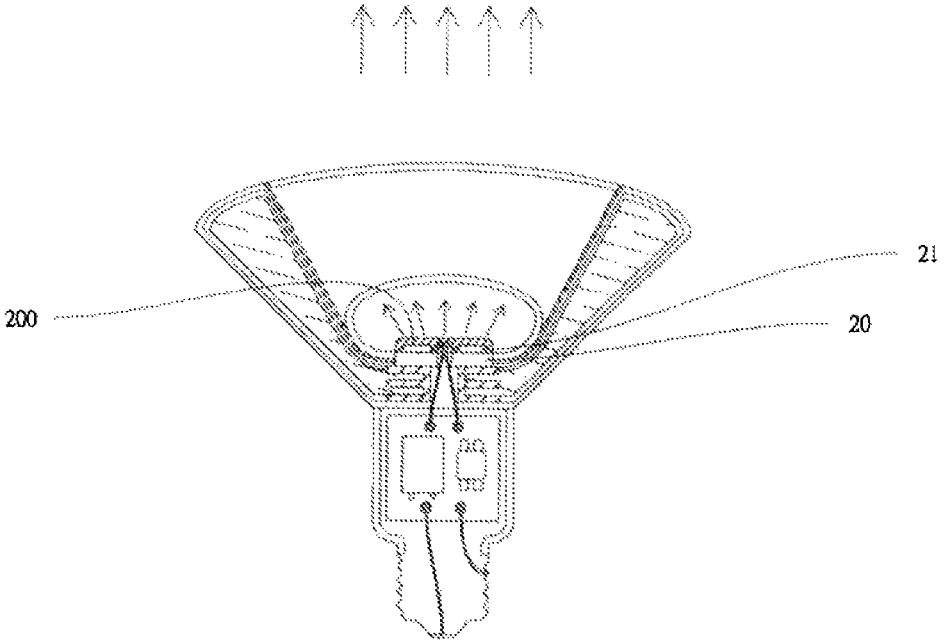
FIG. 2 is a schematic, cross-sectional view of an alternative example of the light-emitting diode illumination apparatus according to the first preferred embodiment of the invention.

FIG. 2 is a schematic, cross-sectional view of an alternative example of the light-emitting diode illumination apparatus according to the first preferred embodiment of the invention.

The arrangement shown in FIG. 2 differs from that shown in FIG. 1 in that the phosphor powder layer illustrated in FIG. 1 is replaced by instead coating a phosphor powder layer 200 on the mounting substrate 20 in a manner covering the LED 21 mounted on the mounting substrate 20.

Figure 3:
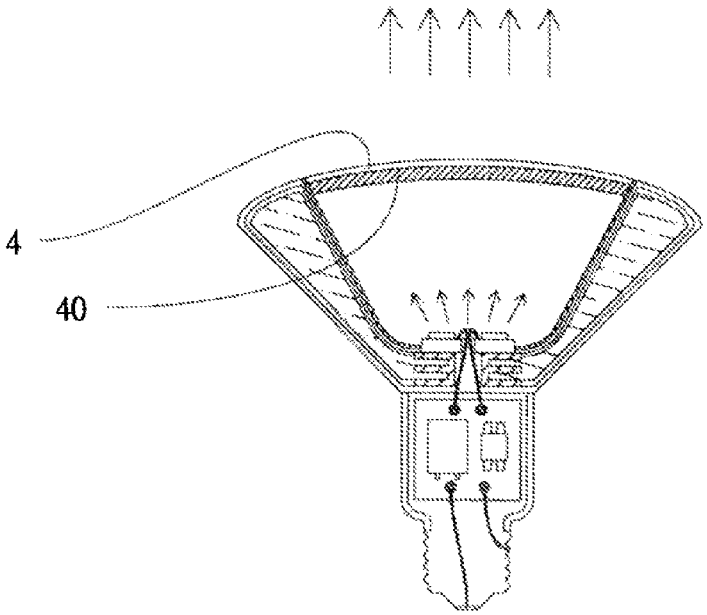
FIG. 3 is a schematic, cross-sectional view of another alternative example of the light-emitting diode illumination apparatus according to the first preferred embodiment of the invention.

FIG. 3 is a schematic, cross-sectional view of another alternative example of the light-emitting diode illumination apparatus according to the first preferred embodiment of the invention.

The arrangement shown in FIG. 3 differs from that shown in FIG. 1 in that the phosphor powder layer illustrated in FIG. 1 is replaced by instead coating a phosphor powder layer 40 on the outer or inner surface of the lens 4.

Figure 4:
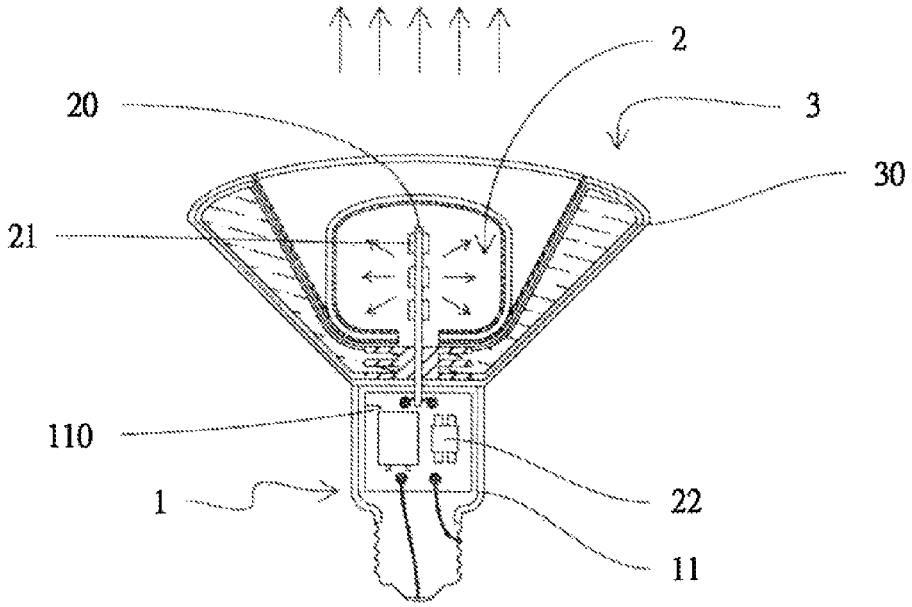
FIG. 4 is a schematic, cross-sectional view of the light-emitting diode illumination apparatus according to the second preferred embodiment of the invention.

FIG. 4 is a schematic, cross-sectional view of the light-emitting diode illumination apparatus according to the second preferred embodiment of the invention.

The LED illumination apparatus shown in FIG. 4 comprises a body 1, a light source module 2 and a heat-dissipating module 3.

The embodiment shown in FIG. 4 differs from that shown in FIG. 1 in that the mounting substrate 20 of the light source module 2 is erectedly disposed with respect to the heat-dissipating member 31, and that the mounting substrate includes two mounting surfaces on which LEDs 21 are operatively mounted in a manner electrically connected to the power source module 22.

Similar to the first preferred embodiment, the embodiment illustrated in FIG. 4 eliminates coincidence of the light path and the heat transfer path and, taking advantage of the separation of light and heat transmission routes, will not generate radiative heat during operation, so that the conventional problem of luminous decay is ameliorated.

Figure 5:
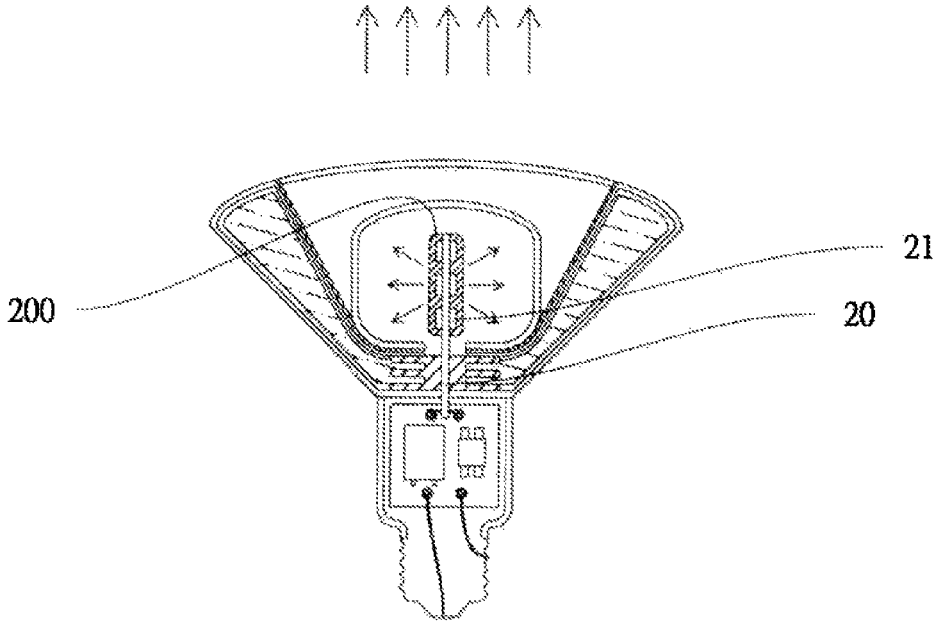
FIG. 5 is a schematic, cross-sectional view of an alternative example of the light-emitting diode illumination apparatus according to the second preferred embodiment of the invention.

FIG. 5 is a schematic, cross-sectional view of an alternative example of the light-emitting diode illumination apparatus according to the second preferred embodiment of the invention.

The arrangement shown in FIG. 5 differs from that shown in FIG. 4 in that the phosphor powder layer illustrated in FIG. 4 is replaced by instead coating a phosphor powder layer 200 on the two mounting surfaces of the mounting substrate 20 in a manner covering the LEDs 21 mounted on the mounting substrate 20.

Figure 6:
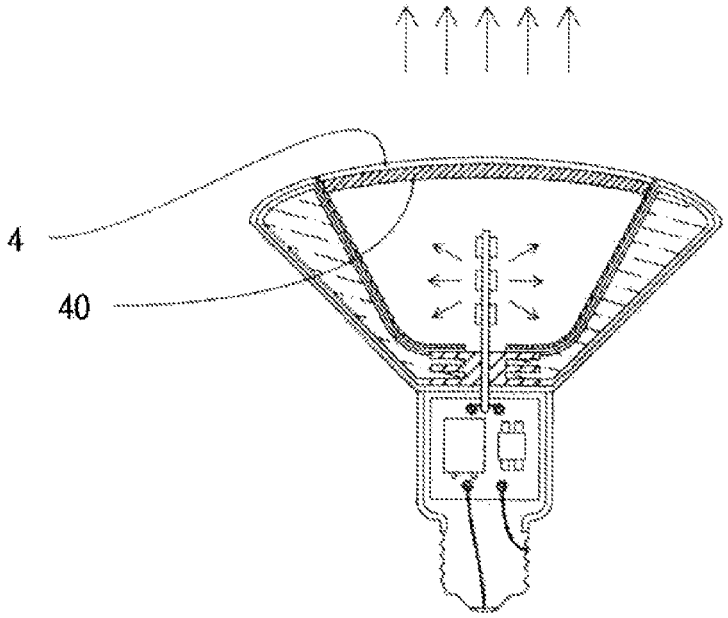
FIG. 6 is a schematic, cross-sectional view of another alternative example of the light-emitting diode illumination apparatus according to the second preferred embodiment of the invention.

FIG. 6 is a schematic, cross-sectional view of another alternative example of the light-emitting diode illumination apparatus according to the second preferred embodiment of the invention.

The arrangement shown in FIG. 6 differs from that shown in FIG. 4 in that the phosphor powder layer illustrated in FIG. 4 is replaced by instead coating a phosphor powder layer 40 on the outer or inner surface of the lens 4.

Figure 7:
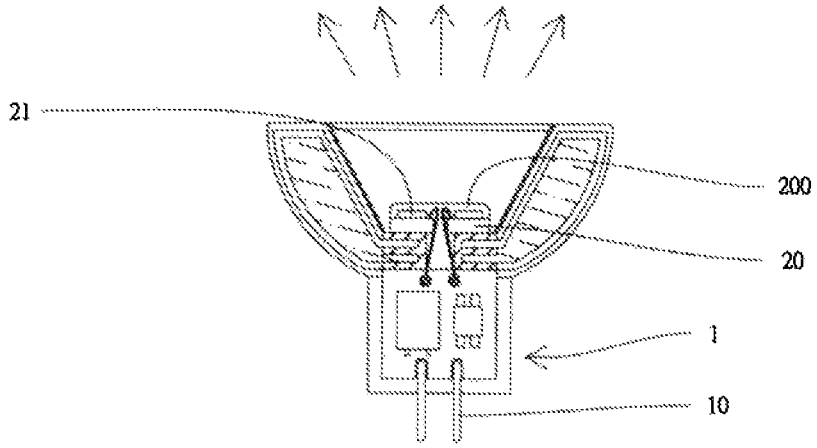
FIG. 7 is a schematic, cross-sectional view of another alternative example of the light-emitting diode illumination apparatus according to the first preferred embodiment of the invention.

FIG. 7 is a schematic, cross-sectional view of another alternative example of the light-emitting diode illumination apparatus according to the first preferred embodiment of the invention.

The arrangement shown in FIG. 7 differs from that shown in FIG. 3 in that the phosphor powder layer illustrated in FIG. 3 is replaced by instead coating a phosphor powder layer 200 on the mounting substrate 20 in a manner covering the LEDs 21 mounted on the mounting substrate 20. In addition, the lower portion 10 of the body 1 is configured in the form of power pins in compliance with standard specifications for projection lamps.

The alternative example illustrated in FIG. 7 similarly eliminates coincidence of the light path and the heat transfer path and, as a result, does not generate radiative heat during operation, so that the conventional problem of luminous decay is ameliorated.

It should be noted that the power pin configuration at the lower portion 10 of the body 1 is applicable to other embodiments disclosed herein.

Figure 8:
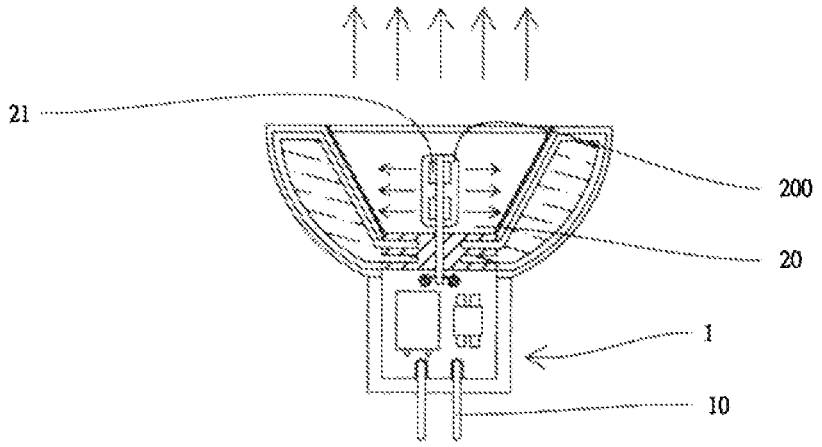
FIG. 8 is a schematic, cross-sectional view of another alternative example of the light-emitting diode illumination apparatus according to the second preferred embodiment of the invention.

FIG. 8 is a schematic, cross-sectional view of another alternative example of the light-emitting diode illumination apparatus according to the second preferred embodiment of the invention.

The arrangement shown in FIG. 8 differs from that shown in FIG. 6 in that the phosphor powder layer illustrated in FIG. 6 is replaced by instead coating a phosphor powder layer 200 on the two mounting surfaces of the mounting substrate 20 in a manner covering the LEDs 21 mounted on the mounting substrate 20. In addition, the lower portion 10 of the body 1 is configured in the form of power pins in compliance with standard specifications for projection lamps.

The alternative example illustrated in FIG. 8 similarly eliminates coincidence of the light path and the heat transfer path and, as a result, does not generate radiative heat during operation, so that the conventional problem of luminous decay is ameliorated.

Figure 9:
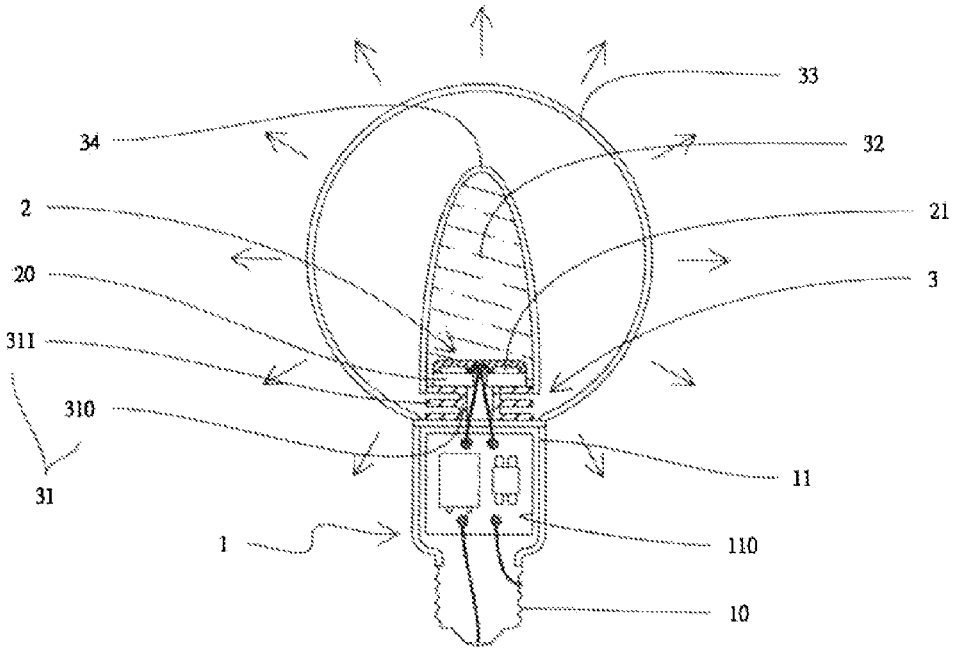
FIG. 9 is a schematic, cross-sectional view of the light-emitting diode illumination apparatus according to the third preferred embodiment of the invention.

FIG. 9 is a schematic, cross-sectional view of the light-emitting diode illumination apparatus according to the third preferred embodiment of the invention.

The LED illumination apparatus shown in FIG. 9 comprises a body 1, a light source module 2 and a heat-dissipating module 3.

According to this embodiment, the body 1 has a lower portion 10 configured in the form of a standard E27-type threaded adapter and an upper portion 11 provided with a power source module accommodating chamber 110.

The heat-dissipating module 3 includes a heat-dissipating member 31. The heat-dissipating member 31 includes a heat-dissipating body 310 disposed at a top end of the upper portion 11 of the body 1 and a plurality of heat-dissipating fins 311 radially extending from the heat-dissipating body 310. The heat-dissipating module 3 further includes a transparent protective shield 34 sleeved over an upper end of the heat-dissipating member 31 to define a coolant fluid accommodating space between the transparent protective shield 34 and the heat-dissipating member 31, and a coolant fluid 32 filled within the coolant fluid accommodating space. A generally spherical lamp cover 33 is further provided at a top end of the upper portion 11 of the body 1, so that the heat-dissipating member 31 and the transparent protective shield 34 are both housed inside of the lamp cover 33.

The light source module 2 includes a mounting substrate 20 disposed on the heat-dissipating member 31 and within the coolant fluid accommodating space, at least one LED 21 operatively mounted on the mounting substrate 20, and a power source module 22 installed within the power source module accommodating chamber 110 of the body 1. The LED 21 is electrically connected to the power source module 22, so as to receive power supply from the power source module 22. Furthermore, the LED 21 may be mounted on the mounting substrate 20 by an alternative means other than that shown in FIG. 9.

Figure 10:
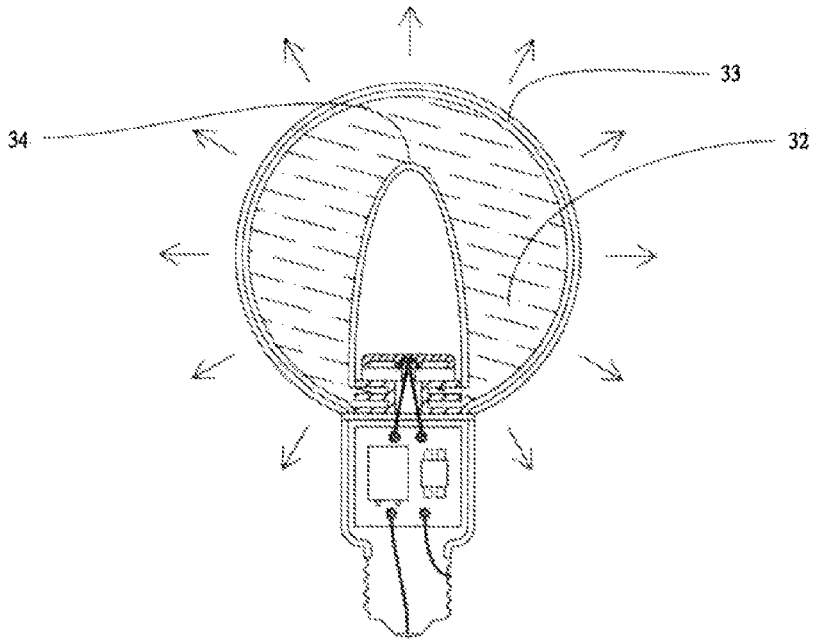
FIG. 10 is a schematic, cross-sectional view of an alternative example of the light-emitting diode illumination apparatus according to the third preferred embodiment of the invention.

FIG. 10 is a schematic, cross-sectional view of an alternative example of the light-emitting diode illumination apparatus according to the third preferred embodiment of the invention.

The arrangement shown in FIG. 10 differs from that shown in FIG. 9 in that the coolant fluid 32 is filled within a space between the lamp cover 33 and the transparent protective shield 34, rather than within the coolant fluid accommodating space.

Figure 11:
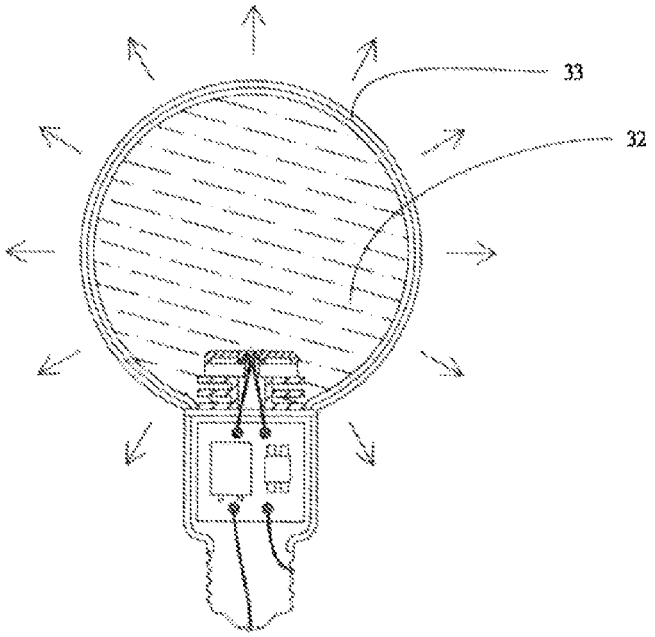
FIG. 11 is a schematic, cross-sectional view of another alternative example of the light-emitting diode illumination apparatus according to the third preferred embodiment of the invention.

FIG. 11 is a schematic, cross-sectional view of another alternative example of the light-emitting diode illumination apparatus according to the third preferred embodiment of the invention.

The arrangement shown in FIG. 11 differs from that shown in FIG. 9 in that the transparent protective shield 34 illustrated in FIG. 9 is omitted, and that the lamp cover 33 is filled up with the coolant fluid 32.

Figure 12:
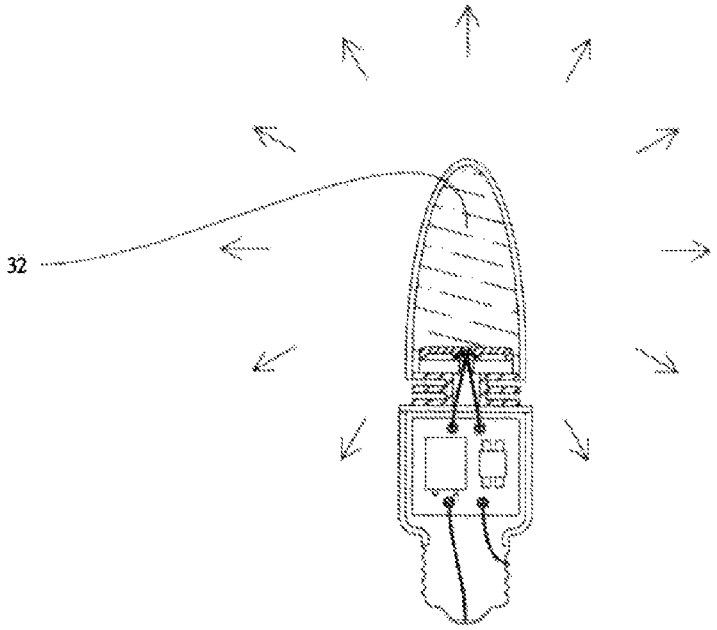
FIG. 12 is a schematic, cross-sectional view of another alternative example of the light-emitting diode illumination apparatus according to the third preferred embodiment of the invention.

FIG. 12 is a schematic, cross-sectional view of still another alternative example of the light-emitting diode illumination apparatus according to the third preferred embodiment of the invention.

The arrangement shown in FIG. 12 differs from that shown in FIG. 9 in that the lamp cover 33 illustrated in FIG. 9 is omitted.

Figure 13:
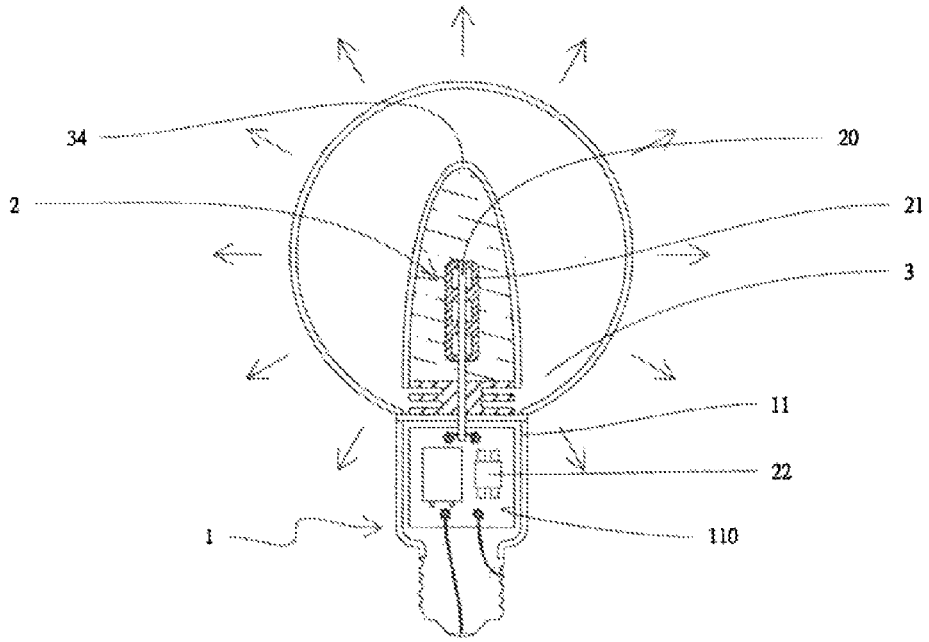
FIG. 13 is a schematic, cross-sectional view of the light-emitting diode illumination apparatus according to the fourth preferred embodiment of the invention.

FIG. 13 is a schematic, cross-sectional view of the light-emitting diode illumination apparatus according to the fourth preferred embodiment of the invention.

The arrangement shown in FIG. 13 differs from that shown in FIG. 9 in that the mounting substrate 20 of the light source module 2 is arranged in parallel to a longitudinal axis of the transparent protective shield 34, so that the mounting substrate 20 extends at one end thereof to the power source module accommodating chamber 110 of the upper portion 11 of the body 1, in which the power source module is housed, and in that the mounting substrate 20 includes two mounting surfaces on which LEDs 21 are operatively mounted in a manner electrically connected to the power source module 22.

Figure 14:
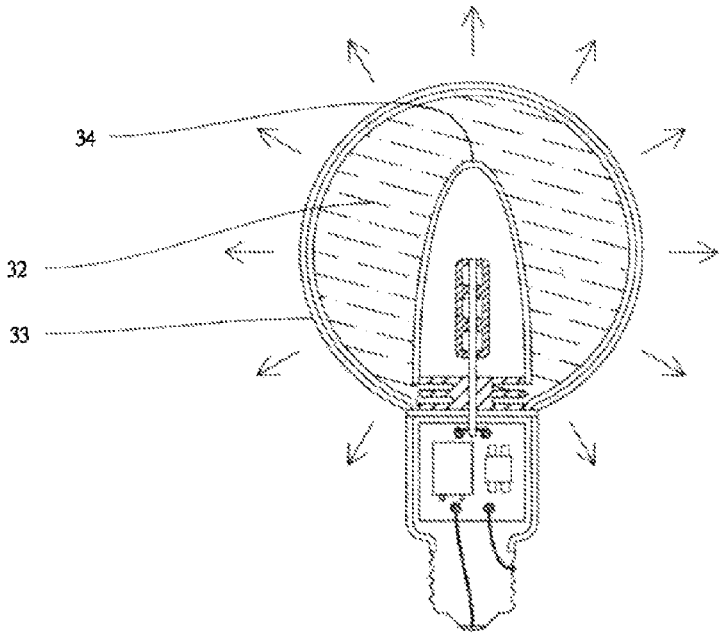
FIG. 14 is a schematic, cross-sectional view of an alternative example of the light-emitting diode illumination apparatus according to the fourth preferred embodiment of the invention.

FIG. 14 is a schematic, cross-sectional view of an alternative example of the light-emitting diode illumination apparatus according to the fourth preferred embodiment of the invention.

The arrangement shown in FIG. 14 differs from that shown in FIG. 13 in that the coolant fluid 32 is filled within a space between the lamp cover 33 and the transparent protective shield 34, rather than within the coolant fluid accommodating space.

Figure 15:
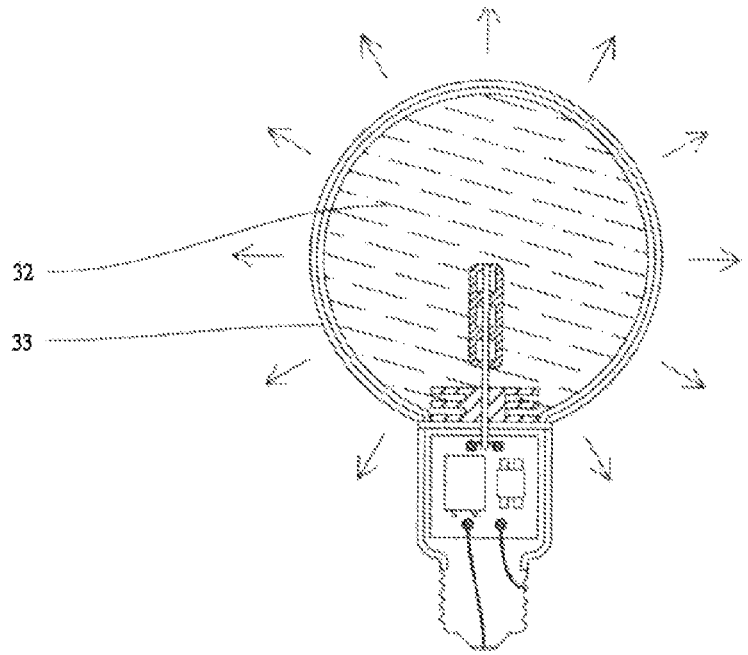
FIG. 15 is a schematic, cross-sectional view of another alternative example of the light-emitting diode illumination apparatus according to the fourth preferred embodiment of the invention.

FIG. 15 is a schematic, cross-sectional view of another alternative example of the light-emitting diode illumination apparatus according to the fourth preferred embodiment of the invention.

The arrangement shown in FIG. 15 differs from that shown in FIG. 13 in that the transparent protective shield 34 illustrated in FIG. 9 is omitted, and that the lamp cover 33 is filled up with the coolant fluid 32.

Figure 16:
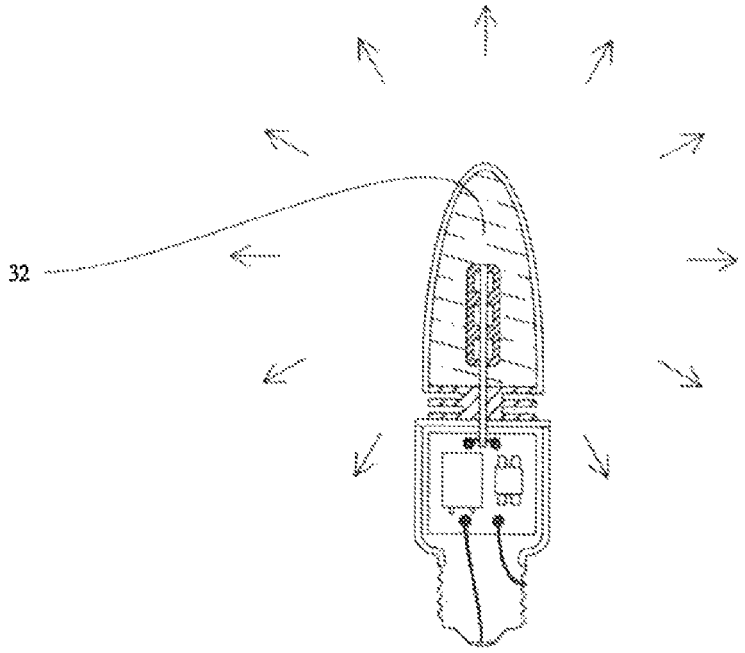
FIG. 16 is a schematic, cross-sectional view of still another alternative example of the light-emitting diode illumination apparatus according to the fourth preferred embodiment of the invention.

FIG. 16 is a schematic, cross-sectional view of still another alternative example of the light-emitting diode illumination apparatus according to the fourth preferred embodiment of the invention.

The arrangement shown in FIG. 16 differs from that shown in FIG. 13 in that the lamp cover 33 illustrated in FIG. 13 is omitted.

Figure 17:
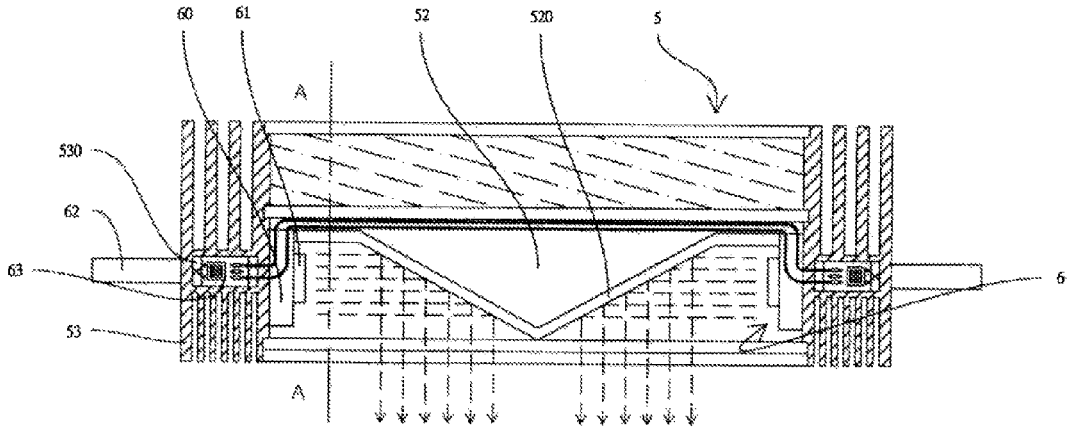
FIGS. 17 and 17A are schematic, cross-sectional views of the light-emitting diode illumination apparatus according to the fifth preferred embodiment of the invention.
Figure 17A:
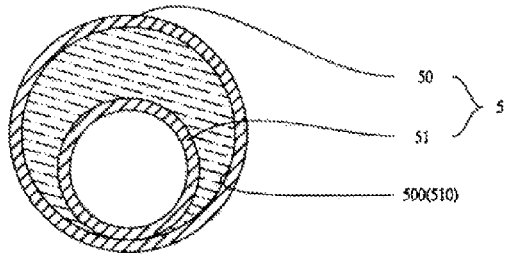

FIGS. 17 and 17A are schematic, cross-sectional views of the light-emitting diode illumination apparatus according to the fifth preferred embodiment of the invention.

The light-emitting diode illumination apparatus shown in FIGS. 17 and 17A generally comprises a housing 5 and a light source module 6.

According to this embodiment, the housing 5 is composed of two elongated hollow transparent tubes 50,51. The first transparent tube 50 has a diameter greater than that of the second transparent tube 51. The transparent tubes 50,51 are arranged to be eccentric to each other, so that the second transparent tube 51 has an outer surface in contact, in part, with an inner surface of the first transparent tube 50, thereby defining a generally C-shaped coolant fluid accommodating space 500 between an non-contact portion of the outer surface of the second transparent tube 51 and an non-contact portion of the inner surface of the first transparent tube 50, which is adapted for accommodating a coolant fluid 510. A reflective plate 52 is fixed within the second transparent tube 51 in a manner extending from one end to the other end of the second transparent tube 51. The reflective plate 52 has a reflective surface 520 arranged to face the surface where the tubes 50,51 are brought in contact with each other.

According to this embodiment, the reflective plate 52 is protruded at its central portion towards the surface where the tubes 50,51 are brought in contact with each other, so that when light is emitted from both ends of the housing 5, the emitted light will exit from the housing 5 due to being reflected by the protruded central portion of the reflective plate 52.

The respective ends of the housing 5 are sealed by a seal member 53. In this embodiment, the respective seal members 53 are made of material that facilitates heat dissipation and provided with a power source module accommodating chamber 530. It should be noted that the invention encompasses the case where only one of the seal members 53 is provided with a power source module accommodating chamber 530.

The light source module 6 includes two mounting substrates 60 each being disposed on an inner surface of a corresponding one of the seal members 53 which faces inside of the second transparent tube 51, at least two LEDs 61 each being mounted on a corresponding one of the mounting substrates 60, mounting electrodes 62 each extending outwardly from an outer surface of a corresponding one of the seal members 53 and adapted for directly coupling to a commercially available power socket, and power source modules 63 each being disposed within a corresponding one of the power source module accommodating chambers 530 of the seal members 53 and adapted for converting mains power transmitted via the mounting electrodes 62 into a usable power source for the LEDs 61.

The LEDs 61 are mounted on the mounting substrates 60 by any suitable means, such that they emit light towards each other and the emitted light exits from the housing 5 by being reflected by the protruded central portion of the reflective plate 52.

It should be noted that the eccentric arrangement of the transparent tubes 50,51 is advantageous in eliminating coincidence of the light path and the heat transfer path and, as a result, does not generate radiative heat during operation, so that the conventional problem of luminous decay is ameliorated. On the other hand, the light emission path is not interfered with by the coolant fluid 510, so that the brightness of light is not reduced.

Figure 18:
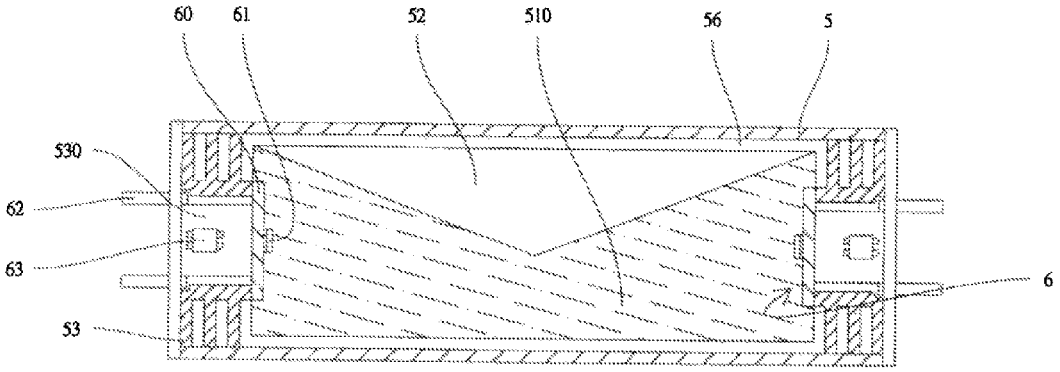
FIG. 18 is a schematic, cross-sectional view of the light-emitting diode illumination apparatus according to the sixth preferred embodiment of the invention.

FIG. 18 is a schematic, cross-sectional view of the light-emitting diode illumination apparatus according to the sixth preferred embodiment of the invention.

The LED illumination apparatus shown in FIG. 18 generally comprises a housing 5 and a light source module 6.

The housing 5 is configured in the form of an elongated hollow transparent tube. A reflective plate 52 is fixed within the housing 5 in a manner extending from one end to the other end of the housing 5. Similar to the fifth preferred embodiment, the reflective plate 52 according to this embodiment is protruded at its central portion.

The respective ends of the housing 5 are sealed by a seal member 53. In this embodiment, the respective seal members 53 are made of material that facilitates heat dissipation and provided with a power source module accommodating chamber 530 for housing a power source module 63.

The light source module 6 includes two mounting substrates 60 each being disposed on an inner surface of a corresponding one of the seal members 53 which faces inside of the housing 5, at least two LEDs 61 each being mounted on a corresponding one of the mounting substrates 60 in a manner electrically connected to the respective one of the power source modules 63, mounting electrodes 62 each extending outwardly from an outer surface of a corresponding one of the seal members 53 and adapted for directly coupling to a commercially available power socket, and power source modules 63 each being disposed within a corresponding one of the power source module accommodating chambers 530 of the seal members 53 and adapted for converting mains power transmitted via the mounting electrodes 62 into a usable power source for the LEDs 61.

The LEDs 61 are mounted on the mounting substrates 60 by any suitable means, such that they emit light towards each other and the emitted light exits from the housing 5 by being reflected by the protruded central portion of the reflective plate 52.

It should be noted that the coolant material 510 is optionally loaded within a container 56 made from transparent plastic material, such as polyethylene (PE) or polyethylene terephthalate (PET), so as to avoid occurrence of accident caused by accidental leakage of the coolant fluid 510 due to rupture of the housing 5.

Figure 19:
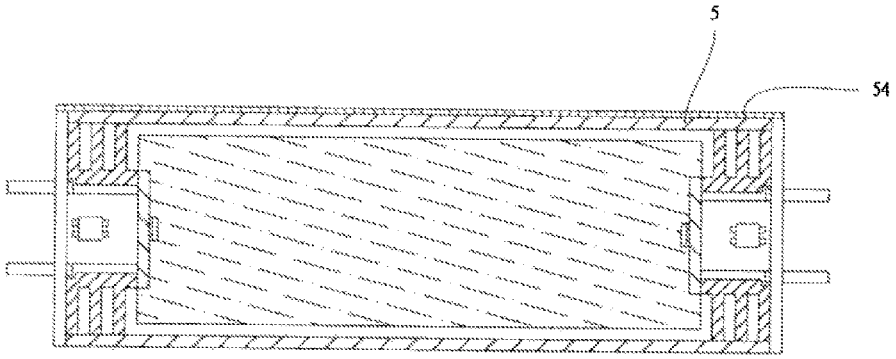
FIG. 19 is a schematic, cross-sectional view of an alternative example of the LED illumination apparatus according to the sixth preferred embodiment of the invention.

FIG. 19 is a schematic, cross-sectional view of an alternative example of the LED illumination apparatus according to the sixth preferred embodiment of the invention.

The arrangement shown in FIG. 19 differs from that shown in FIG. 18 in that the reflective plate illustrated in FIG. 18 is replaced by instead coating a reflective layer 54 on part of an outer surface of the housing 5.

Figure 20:
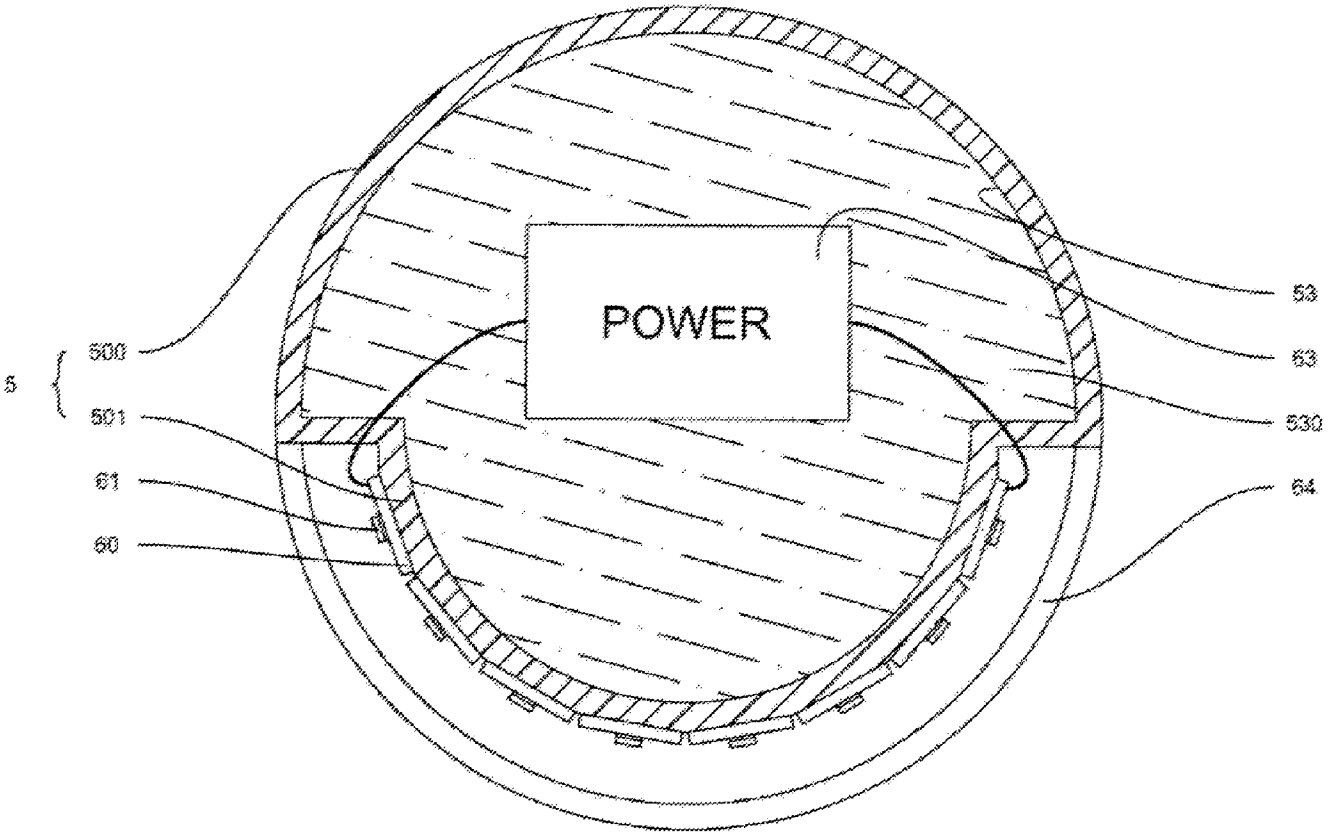
FIG. 20 is a schematic, cross-sectional view of the light-emitting diode illumination apparatus according to the seventh preferred embodiment of the invention.

FIG. 20 is a schematic, cross-sectional view of the light-emitting diode illumination apparatus according to the seventh preferred embodiment of the invention.

The embodiment shown in FIG. 20 comprises a housing 5 and a light source module.

The housing 5 is configured as an elongated hollow tube extending inwardly as depicted in FIG. 20. The housing 5 is composed of a first housing portion 500 having a large, generally C-shaped cross-section and a second housing portion 501 having a small, generally C-shaped cross-section, with open portions of the first and second C-shaped housing portions 500,501 facing each other, so that the housing 5 has a generally T-shaped cross-section, and that an coolant fluid accommodating space 53 is defined between the housing portions 500 and 501 for accommodating a coolant fluid 530.

The light source module comprises a plurality of mounting substrates 60 disposed on an outer surface of the second housing portion 501, a plurality of LEDs 61 mounted on the mounting substrates 60, power source modules 63 for converting mains power into a usable power source for the LEDs 61, and mounting electrodes (not shown in FIG. 20) provided at both ends of the housing 5 as shown in FIG. 17 and adapted for directly coupling to a commercially available power socket. The power source modules 63 are mounted in substantially the same manner as shown in FIG. 17.

Similar to the embodiments described above, the LEDs 61 can be mounted on the mounting substrates 60 by any suitable means.

According to this embodiment, the light source module further comprises a transparent cover 64 having a large, generally C-shaped cross-section and covering over the second housing portion 501, so as to provide protection to the LEDs 61. The transparent cover 64 is integrated with the first housing portion 500 of the housing 5 to form a cylindrical outline.

FIGS. 21 and 21A-E are schematic, cross-sectional views of the light-emitting diode illumination apparatus according to the eighth preferred embodiment of the invention.

Figure 21:
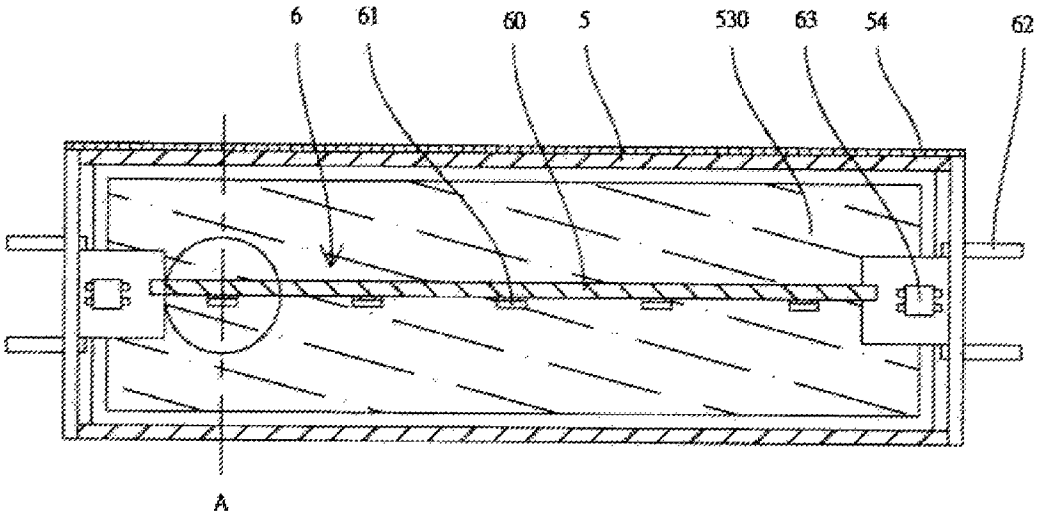
FIGS. 21 and 21A-E are schematic, cross-sectional views of the light-emitting diode illumination apparatus according to the eighth preferred embodiment of the invention.

As shown in FIG. 21, the LED illumination apparatus according to this embodiment comprises a transparent cylindrical housing 5 and a light source module 6.

Figure 21A:
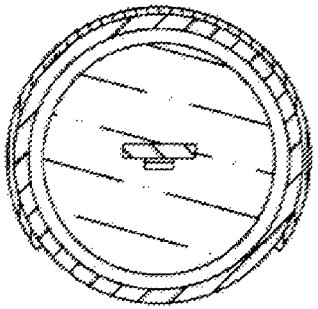
Figure 21B:
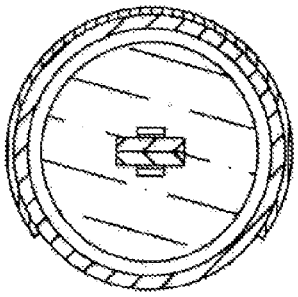
Figure 21C:
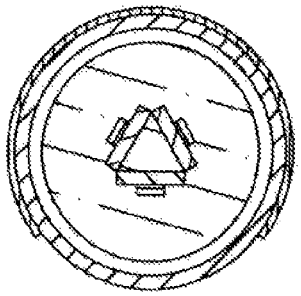
Figure 21D:
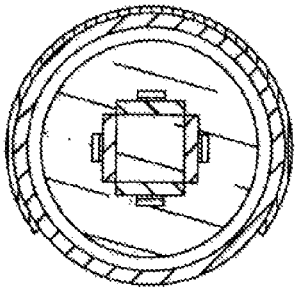
Figure 21E:
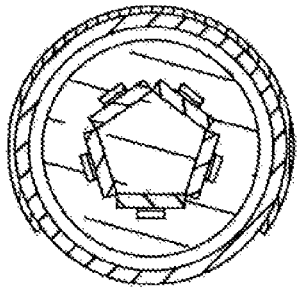

In this embodiment, the housing 5 has an outer surface, of which approximately three-fourth surface area is coated with a reflective layer 54 (see FIG. 21A). The coolant fluid 530 is filled within the housing 5.

The light source module 6 includes mounting electrodes 62 provided at both ends of the housing 5 and adapted for directly coupling to a commercially available power socket, power source modules 63 for converting mains power into a usable power source for the LEDs 61, a mounting substrate 60 extending between the two ends of the housing 5, and a plurality of LEDs 21 arranged in an array and operatively mounted on the mounting substrate 60 in a manner electrically connected to the power source modules 63.

The LEDs 61 are mounted on the mounting substrate 60 by any suitable means, so long as their light emitting surfaces are arranged to face towards a portion of the outer surface of the housing 5 that is not coated with the reflective layer 54.

It should be noted that the reflective layer 54 can be optionally disposed on an inner surface of the housing 5, or can be omitted altogether. On the other hand, the light source module may comprise two or more mounting substrates arranged in the manner shown in FIGS. 21B-E.

Figure 22:
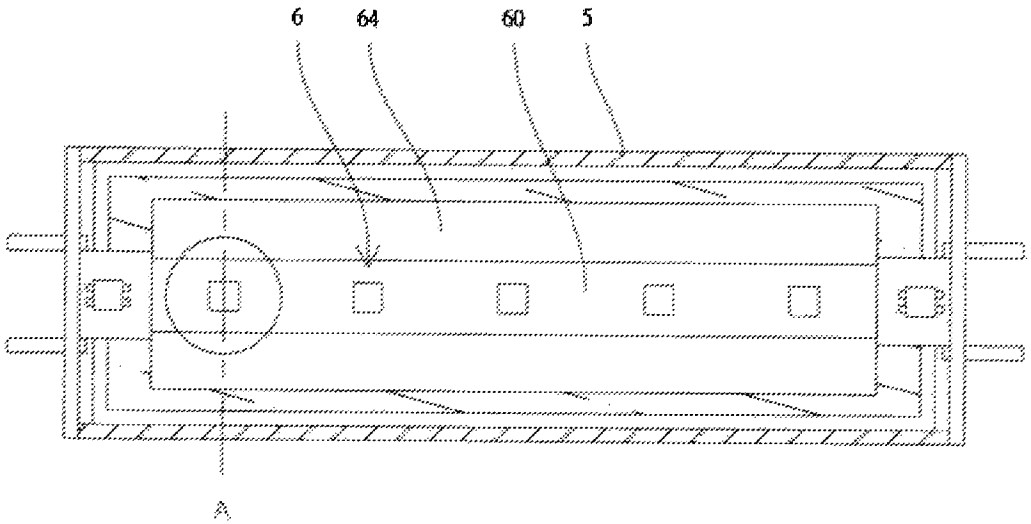
FIGS. 22 and 22A are schematic, cross-sectional views of an alternative example of the light-emitting diode illumination apparatus according to the eighth preferred embodiment of the invention.
Figure 22A:
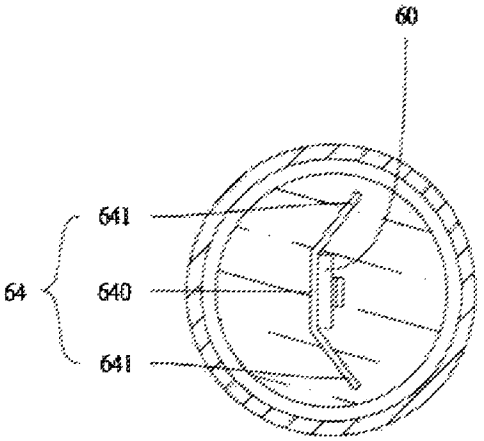

FIGS. 22 and 22A are schematic, cross-sectional views of an alternative example of the light-emitting diode illumination apparatus according to the eighth preferred embodiment of the invention.

The arrangement shown in FIGS. 22 and 22A differs from that shown in FIG. 21 in that the reflective layer disposed on the outer surface of the housing 5 is replaced by instead providing a reflective plate 64 in the light source module 6. The reflective plate 64 has a mounting portion 640 on which the mounting substrate 60 of the light source module 6 are mounted, and wing portions 641 extending from both sides of the mounting portion 640 at an inclined angle of greater than 90° with respect to the mounting portion 640.

Figure 23:
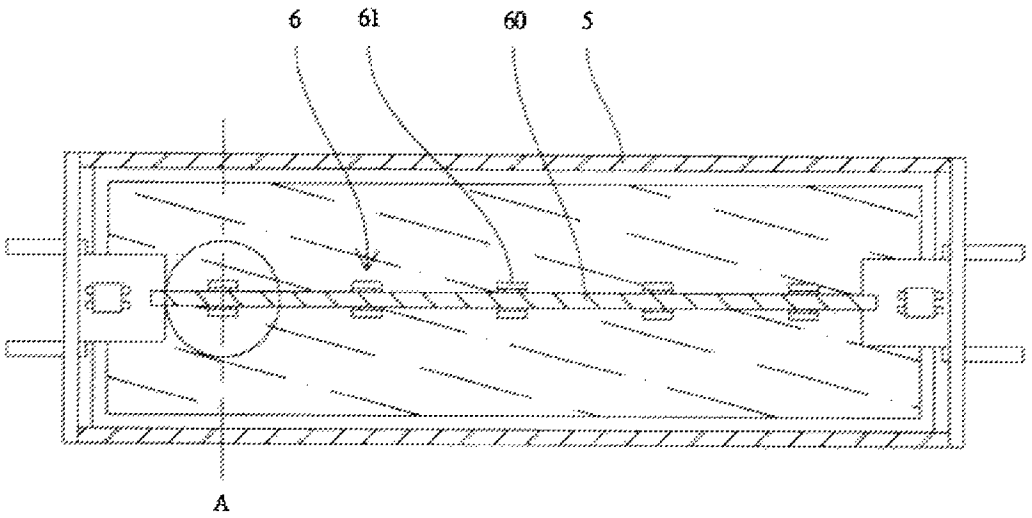
FIGS. 23 and 23A are schematic, cross-sectional views of another alternative example of the light-emitting diode illumination apparatus according to the eighth preferred embodiment of the invention.
Figure 23A:
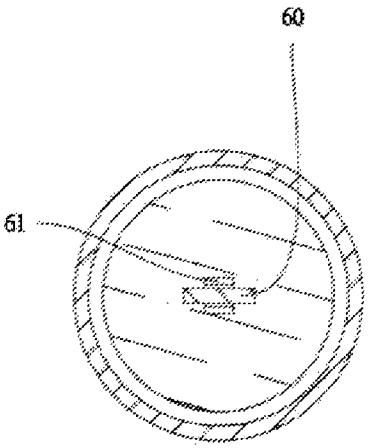

FIGS. 23 and 23A are schematic, cross-sectional views of another alternative example of the light-emitting diode illumination apparatus according to the eighth preferred embodiment of the invention.

The arrangement shown in FIGS. 23 and 23A differs from that shown in FIG. 21 in that the reflective layer disposed on the outer surface of the housing 5 is omitted and both surfaces of the mounting substrate 60 in the light source module 6 are mounted with LEDs 61 arranged in an array configuration by any suitable means.

Figure 24:
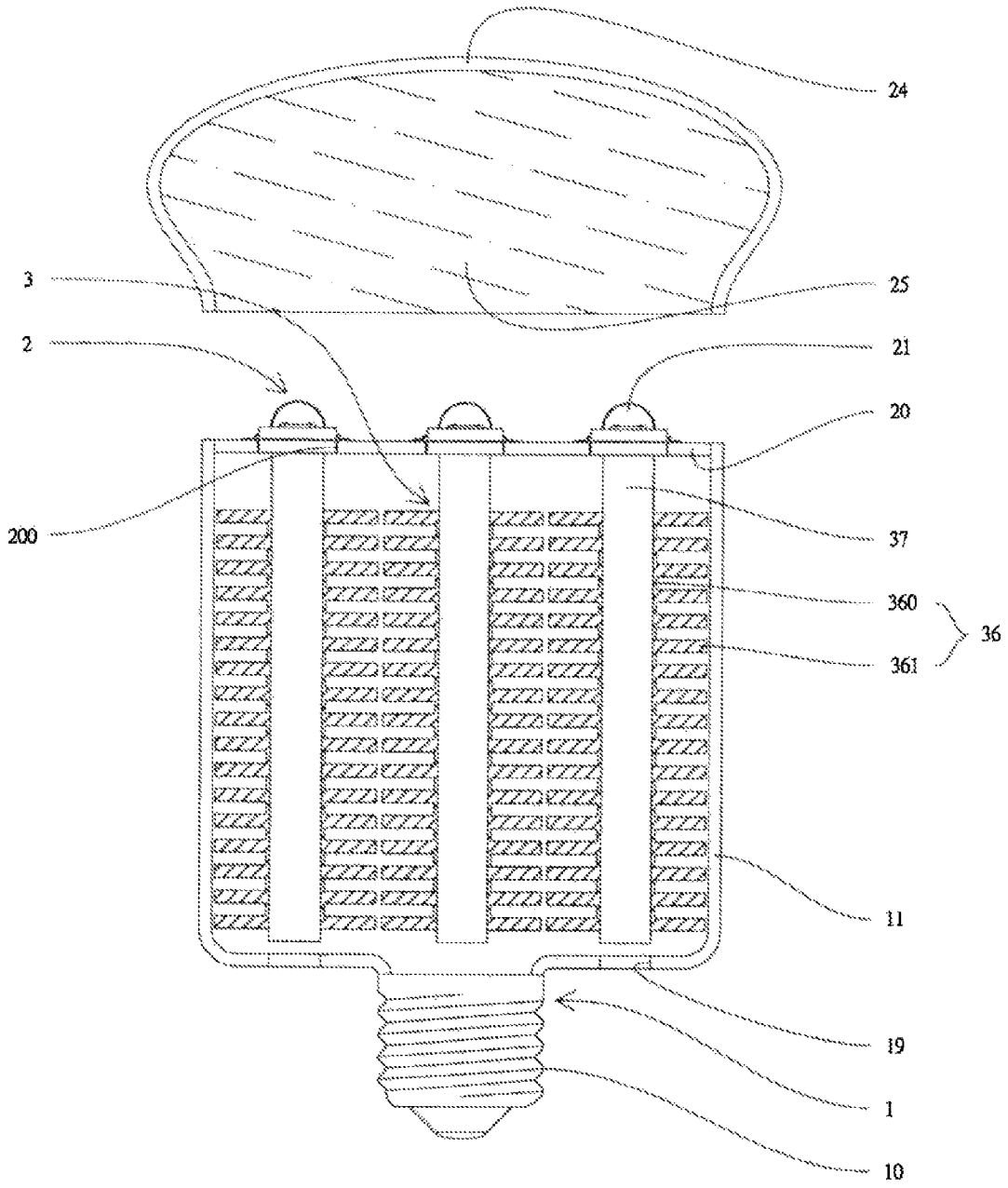
FIG. 24 is a schematic, cross-sectional view of the light-emitting diode illumination apparatus according to the ninth preferred embodiment of the invention.

FIG. 24 is a schematic, cross-sectional view of the light-emitting diode illumination apparatus according to the ninth preferred embodiment of the invention.

The LED illumination apparatus shown in FIG. 24 comprises a hollow body 1, a light source module 2 and a heat-dissipating module 3.

In this embodiment, the body 1 has a lower portion 10 configured in the form of a standard E27-type threaded adapter and is adapted for accommodating a power source module (not shown) of the light source module 2 as described in the embodiments above.

The heat-dissipating module 3 includes a plurality of heat-dissipating fin sets 36 disposed in an array configuration within an upper portion 11 of the body 1, and a plurality of heat pipes 37. The heat-dissipating fin sets 36 each includes a hollow tubular body 360 and a plurality of heat-dissipating fins 361 radially extending from the body 360. The respective heat pipes 37 are disposed within a corresponding one of the body 360. According to this embodiment, the respective heat pipes 37 are protruded at both ends thereof from the corresponding body 360. The upper portion 11 of the body 1 is provided at its end proximal to the lower portion 10 with at least one ventilation hole 19 for optimum air flow.

The light source module 2 comprises a mounting substrate 20 disposed at one end of the upper portion 11 of the body 1, at least one LED 21 electrically connected to a power source module, and a power source module disposed in the lower portion 10 of the body 1. The mounting substrate 20 is formed with a plurality of through holes 200 at positions corresponding to the heat pipes 37, so as to allow the respective heat pipes 37 to be inserted at their ends into a corresponding one of the through holes 200.

Figure 25:
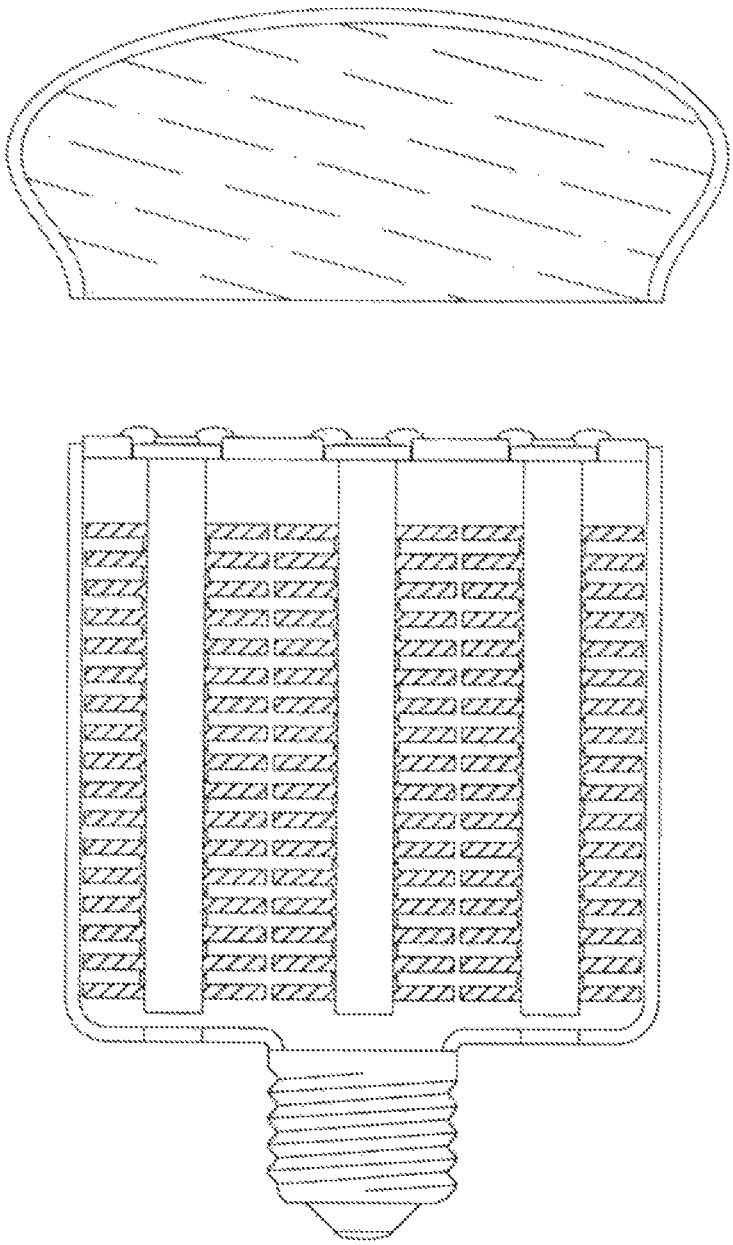
FIGS. 25 and 26 are schematic, cross-sectional views illustrating alternative means for mounting LEDs on the mounting substrate.
Figure 26:
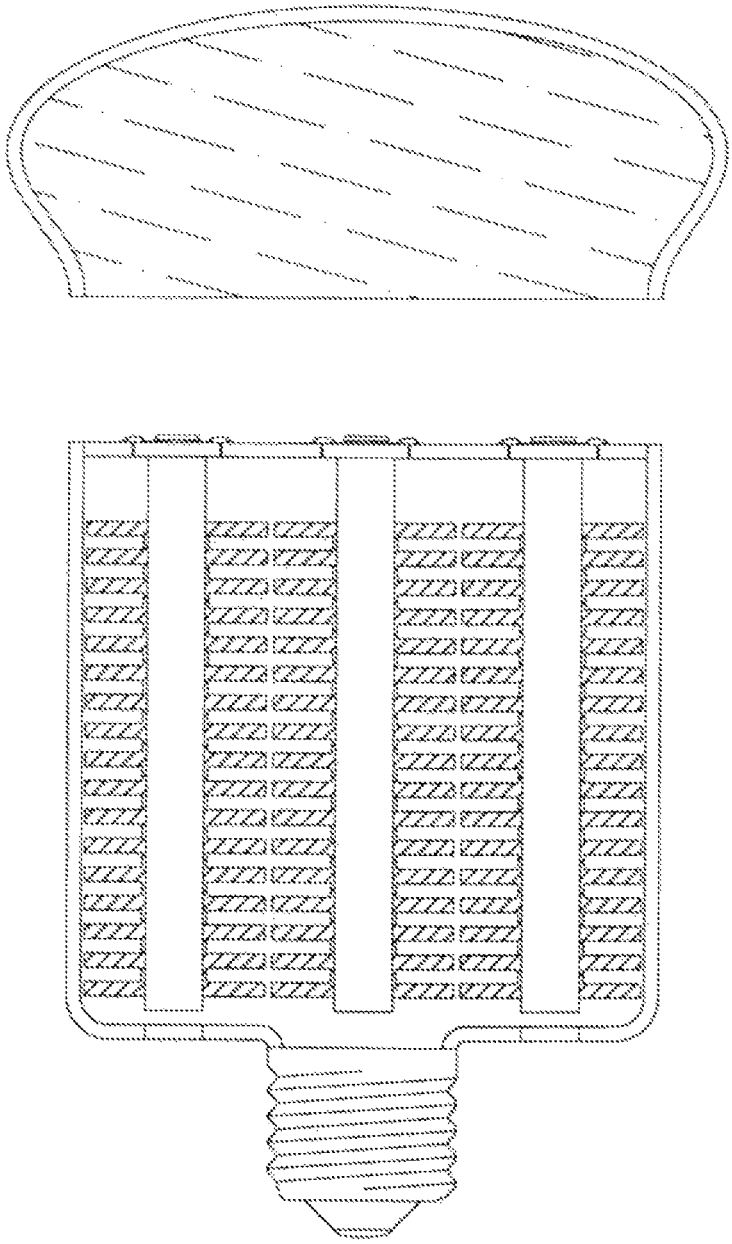

The respective LEDs 21 employed in this embodiment are that commercially available under the trade name Emitter Star, operatively mounted at a corresponding one of the ends of the heat pipes 37 that penetrate through the through holes 200 of the mounting substrate 20. However, the LEDs 21 may optionally be of other types than Emitter Star and may be mounted at the ends of the heat pipes by any suitable means, such as those shown in FIGS. 25 and 26.

Figure 24A:
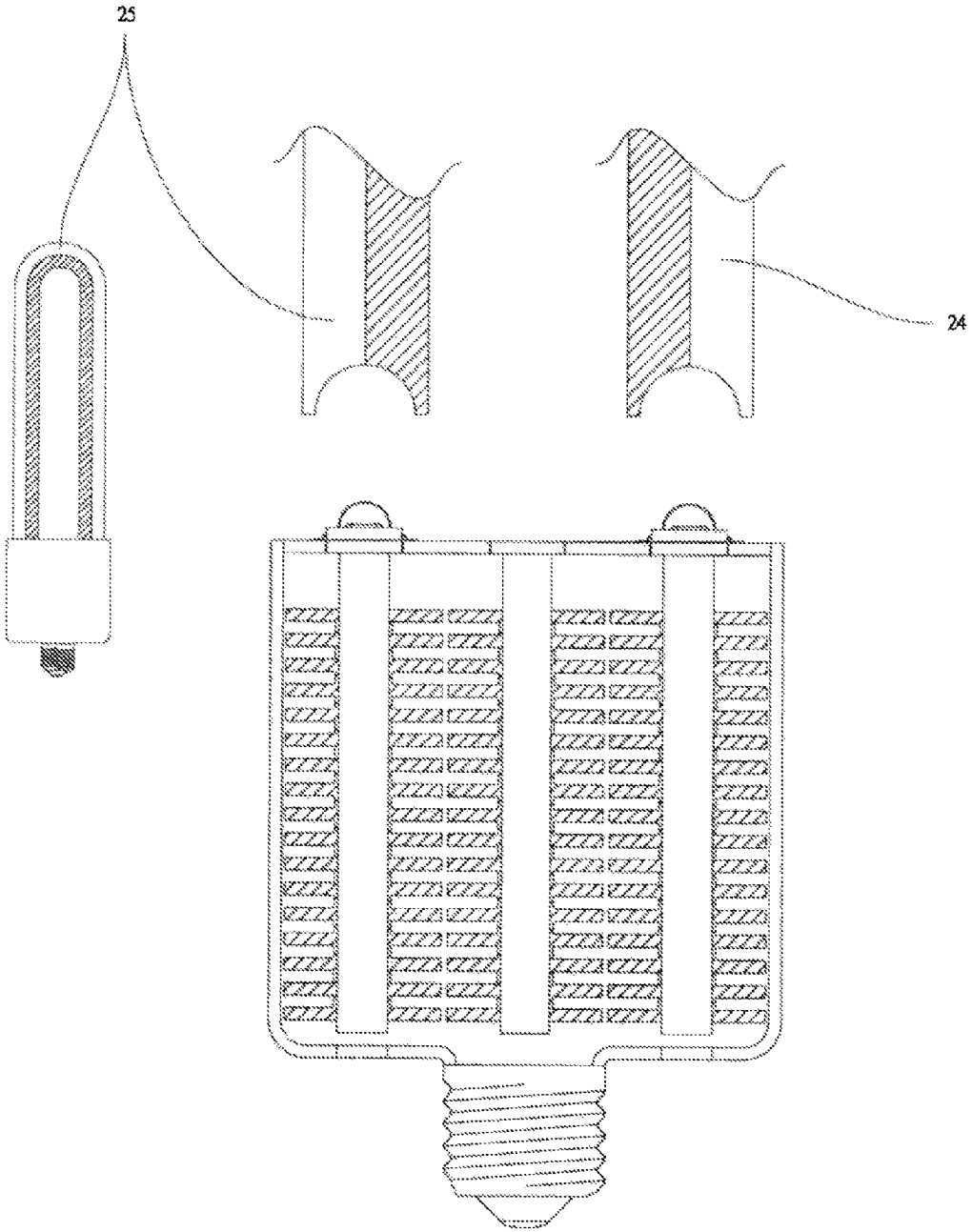
FIGS. 24A and 24B are schematic diagrams illustrating alternative examples of the protective shield employed in the ninth preferred embodiment of the invention.
Figure 24B:
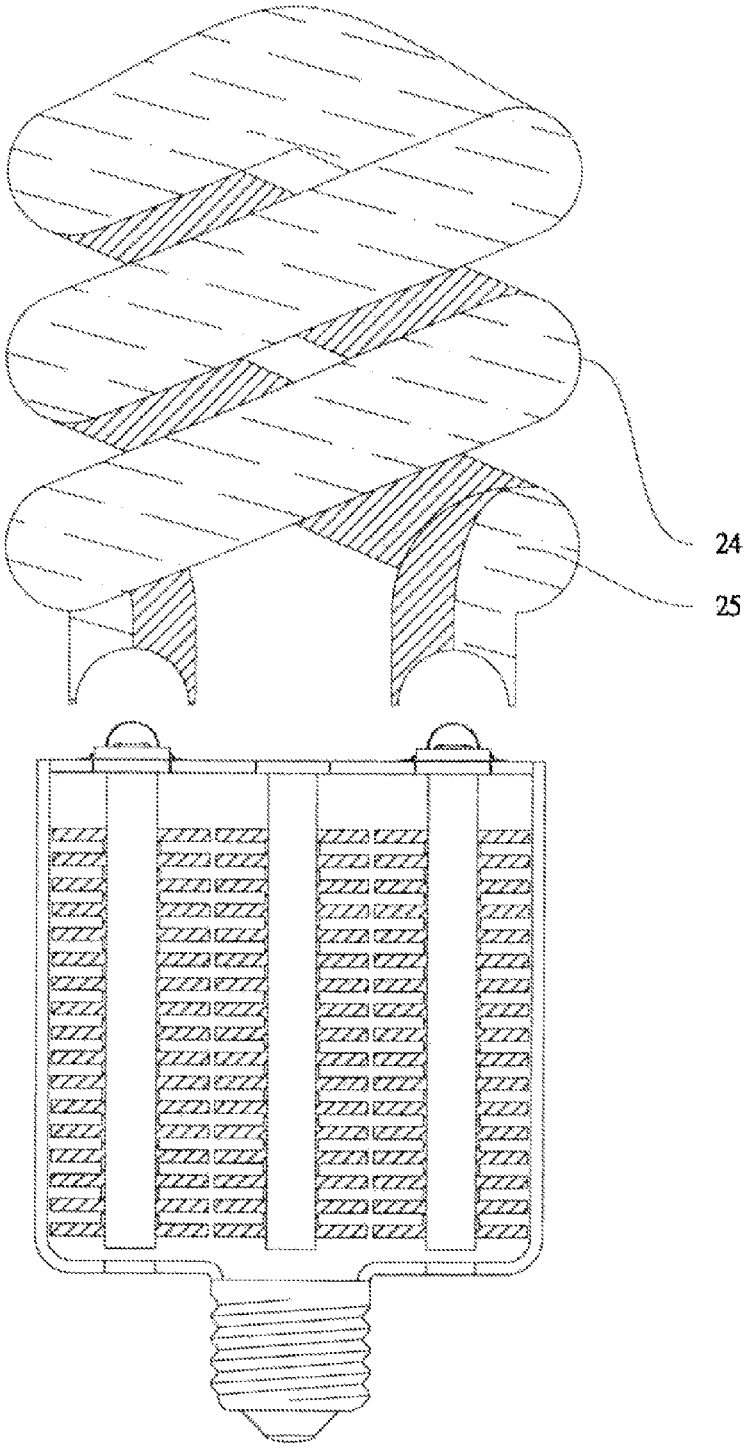

The light source module 2 further includes a transparent protective shield 24 that serves as a lamp cover. The protective shield 24 is disposed on the upper portion of the body 1 in a manner covering over the mounting substrate 20, so as to protect the LEDs 21 from external damage. In this embodiment, the protective shield 24 may be filled with an insulative coolant fluid 25 to reduce the working temperature of the LEDs 21. It should be noted that the outline of the protective shield 24 is not limited to that shown in FIG. 24, but includes any configurations as long as they are appropriate, such as those shown in FIGS. 24A and 24B.

Figure 27:
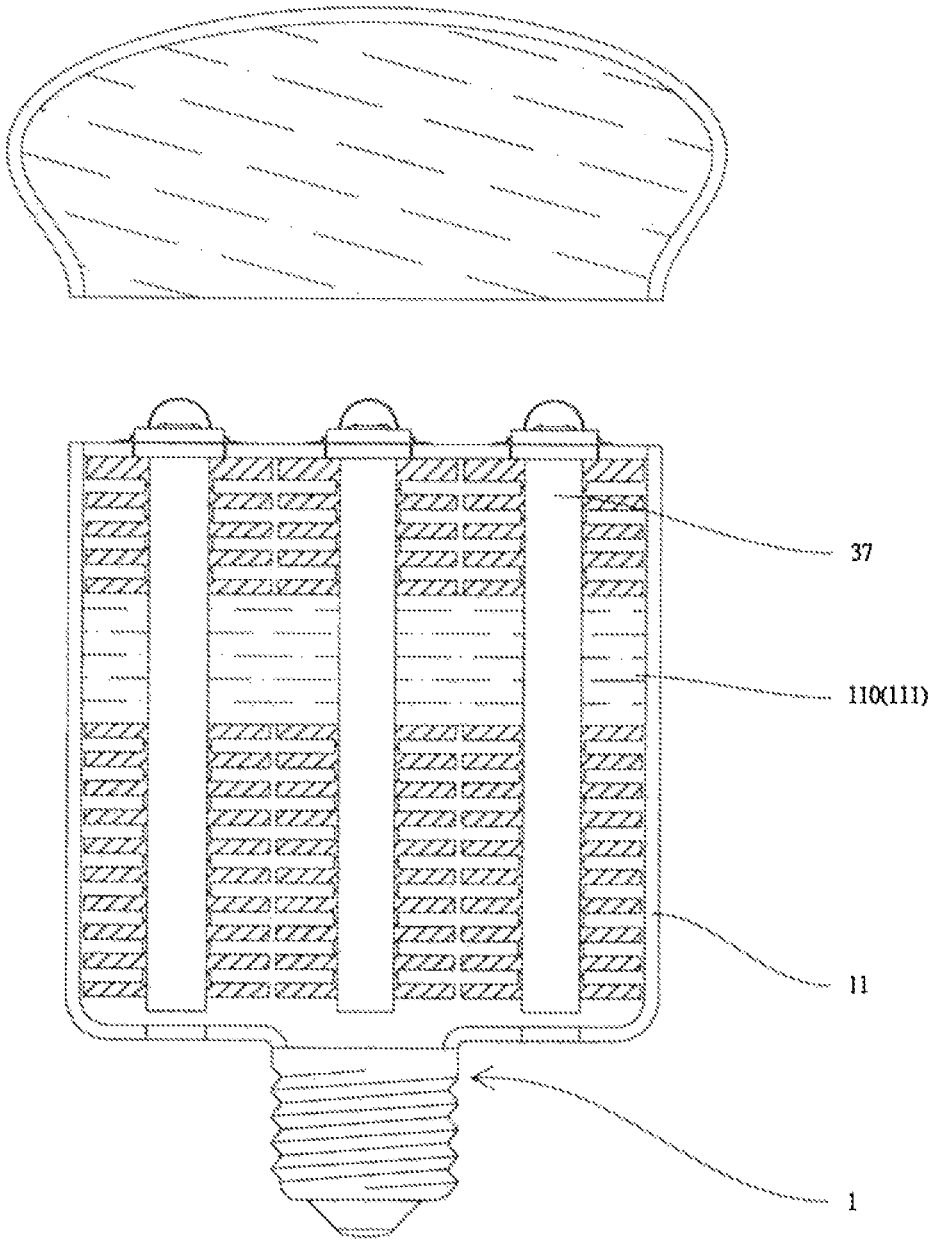
FIG. 27 is a schematic, cross-sectional view of an alternative example of the light-emitting diode illumination apparatus according to the ninth preferred embodiment of the invention.

FIG. 27 is a schematic, cross-sectional view of an alternative example of the light-emitting diode illumination apparatus according to the ninth preferred embodiment of the invention.

The arrangement shown in FIG. 27 differs from that shown in FIG. 24 in that the upper portion 11 of the body 1 is additionally provided with a coolant fluid accommodating section 110, in which a coolant fluid 111 is filled. The heat pipes 37 are arranged to traverse across the coolant fluid accommodating section 110, so as to enhance the heat transfer performance of the heat pipes 37.

Figure 28:
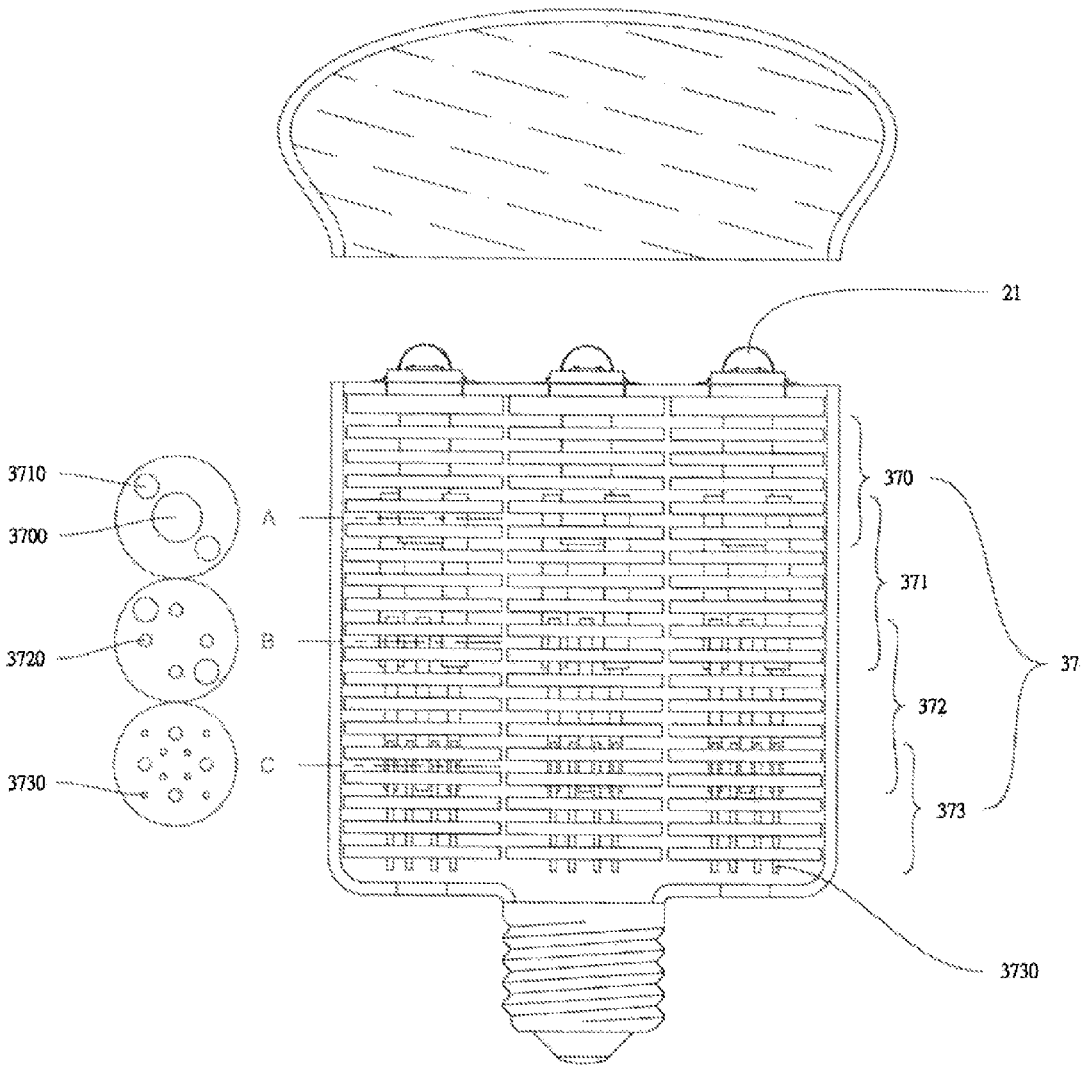
FIG. 28 is a schematic, cross-sectional view of another alternative example of the light-emitting diode illumination apparatus according to the ninth preferred embodiment of the invention.

FIG. 28 is a schematic, cross-sectional view of another alternative example of the light-emitting diode illumination apparatus according to the ninth preferred embodiment of the invention.

The arrangement shown in FIG. 28 differs from that shown in FIG. 24 in that the respective heat pipes 37 are composed of first to fourth heat pipe portions 370-373. The first heat pipe portion 370 of each heat pipe 37 comprises a heat pipe 3700 having a first end at which an LED 21 is mounted. The second heat pipe portion 371 of each heat pipe 37 comprises two heat pipes 3710 disposed at both sides of the second end of the heat pipe 3700 of the corresponding first heat pipe portion 370 opposite to the first end (see FIG. 28, Panel A). The third heat pipe portion 372 of each heat pipe 37 comprises four heat pipes 3720 disposed at both sides of the ends of the two heat pipes 3710 of the second heat pipe portion 371 distal to the first heat pipe portion 370 (see FIG. 28, Panel B). The fourth heat pipe portion 373 of each heat pipe 37 comprises eight heat pipes 3730 disposed at both sides of the ends of the four heat pipes 3720 of the third heat pipe portion 372 distal to the second heat pipe portion 371 (see FIG. 28, Panel C).

Figure 29:
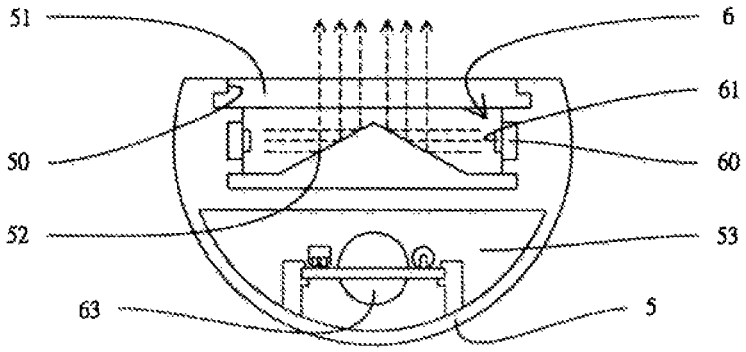
FIG. 29 is a schematic, cross-sectional view of the light-emitting diode illumination apparatus according to the tenth preferred embodiment of the invention.

FIG. 29 is a schematic, cross-sectional view of the light-emitting diode illumination apparatus according to the tenth preferred embodiment of the invention.

The LED illumination apparatus shown in FIG. 29 generally comprises a housing 5 and a light source module 6.

According to this embodiment, the housing 5 is configured as an elongated hollow tube extending inwardly as depicted in FIG. 29, which is made of material with high heat-dissipating capability. The housing 5 is formed with a longitudinally extending elongated opening 50 on its wall. The elongated opening 50 is sealed by a transparent plate 51. A longitudinally extending elongated reflective plate 52 is disposed inside of the housing 5 in a manner facing the opening 50. The reflective plate 52 has a central portion protruded towards the opening 50.

A power source module accommodating space 53 is defined in the housing 5 at the backside of the reflective plate 52 and adapted for accommodating a power source module 63 of the light source module 6. It should be noted that the power source module accommodating space 53 can be filled with a coolant fluid.

The light source module 6 comprises two longitudinally extending elongated mounting substrates 60 disposed on an inner surface of the housing 5 in a manner facing each other. The respective mounting substrates 60 have an LED mounting surface facing the protruded central portion of the reflective plate 52.

The light source module 6 further comprises a plurality of LEDs 61 mounted on the LED mounting surfaces of the mounting substrates 60 in a manner electrically connected to the power source module 63, mounting electrodes (not shown) provided at both ends of the housing 5 as described in the embodiments above and adapted for directly coupling to a commercially available power socket, and a power source module 63 for converting mains power into a usable power source for the LEDs 61.

The LEDs 61 are mounted on the mounting substrates 60 by any suitable means, such that the LEDs emit light towards the protruded central portion of the reflective plate 52. As a result, the light emitted from the LEDs 61 will exit from the housing 5 through the opening 50 due to being reflected by the reflective plate 52.

Figure 30:
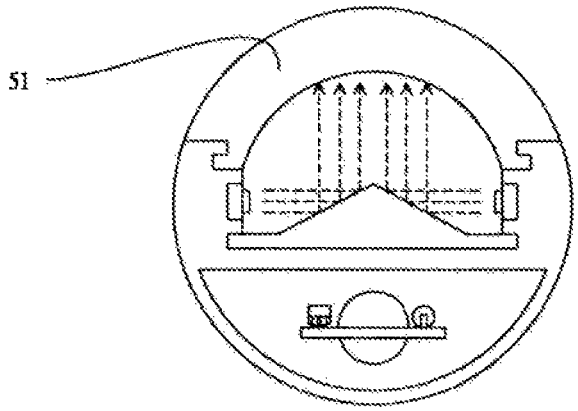
FIG. 30 is a schematic, cross-sectional view of an alternative example of the light-emitting diode illumination apparatus according to the ninth preferred embodiment of the invention.

FIG. 30 is a schematic, cross-sectional view of an alternative example of the light-emitting diode illumination apparatus according to the tenth preferred embodiment of the invention.

The arrangement shown in FIG. 30 differs from that shown in FIG. 29 in the shape of the transparent plate 51.

Figure 31:
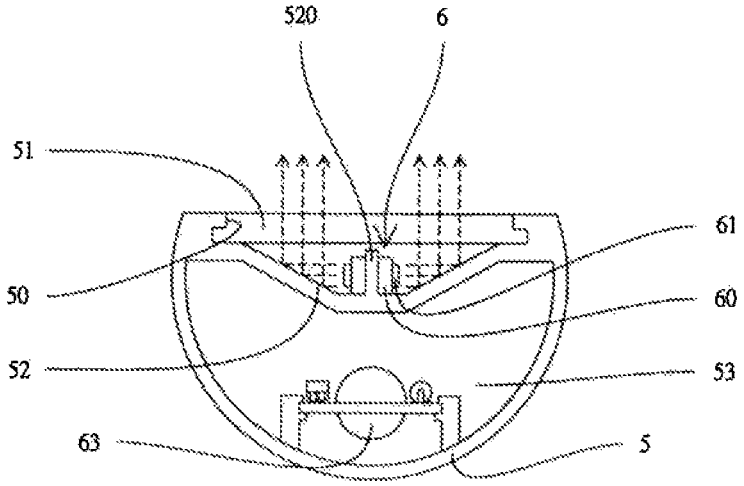
FIG. 31 is a schematic, cross-sectional view of the light-emitting diode illumination apparatus according to the eleventh preferred embodiment of the invention.

FIG. 31 is a schematic, cross-sectional view of the light-emitting diode illumination apparatus according to the eleventh preferred embodiment of the invention.

The LED illumination apparatus shown in FIG. 31 generally comprises a housing 5 and a light source module 6.

According to this embodiment, the housing 5 is configured as an elongated hollow tube (extending inwardly as depicted in FIG. 31) made of any suitable material. The housing 5 is formed with a longitudinally extending elongated opening 50 on its wall. The elongated opening 50 is sealed by a transparent plate 51. A longitudinally extending elongated reflective plate 52 having a generally V-shaped cross-section is disposed inside of the housing 5 in a manner facing the opening 50. The reflective plate 52 has a central portion protruded towards the opening 50. A mounting board 520 extends upwardly from a central portion of the reflective plate 52.

A power source module accommodating space 53 is defined in the housing 5 at the backside of the reflective plate 52 and adapted for accommodating a power source module 63 of the light source module 6. It should be noted that the power source module accommodating space 53 can be filled with a coolant fluid.

The light source module 6 comprises mounting substrates 60 disposed on opposite surfaces of the mounting board 520 of the reflective plate 52, a plurality of LEDs 61 mounted on the mounting substrates 60 in a manner electrically connected to the power source module 63, mounting electrodes (not shown) provided at both ends of the housing 5 as described in the embodiments above and adapted for directly coupling to a commercially available power socket, and a power source module 63 for converting mains power into a usable power source for the LEDs 61.

The LEDs 61 are mounted on the mounting substrates 60 by any suitable means, such that the LEDs emit light towards opposite inclined reflective portions of the reflective plate 52. As a result, the light emitted from the LEDs 61 will exit from the housing 5 through the opening 50 due to being reflected by the reflective plate 52.

Figure 32:
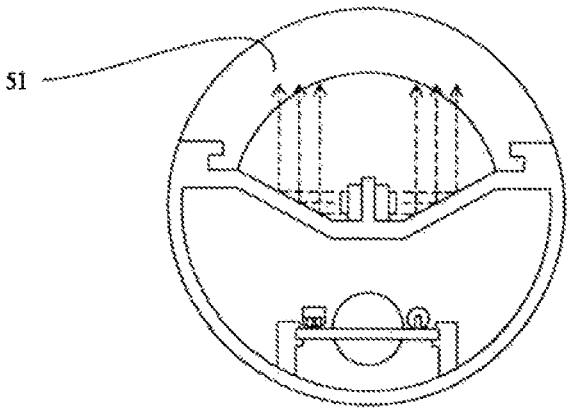
FIG. 32 is a schematic, cross-sectional view of an alternative example of the light-emitting diode illumination apparatus according to the eleventh preferred embodiment of the invention.

FIG. 32 is a schematic, cross-sectional view of an alternative example of the light-emitting diode illumination apparatus according to the eleventh preferred embodiment of the invention.

The arrangement shown in FIG. 32 differs from that shown in FIG. 31 in the shape of the transparent plate 51.

Figure 33:
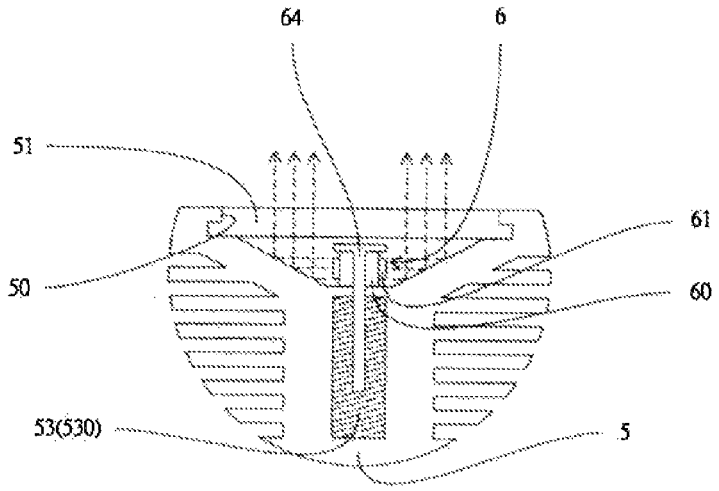
FIG. 33 is a schematic, cross-sectional view of the light-emitting diode illumination apparatus according to the twelfth preferred embodiment of the invention.

FIG. 33 is a schematic, cross-sectional view of the light-emitting diode illumination apparatus according to the twelfth preferred embodiment of the invention.

The LED illumination apparatus shown in FIG. 33 generally comprises a housing 5 and a light source module 6.

According to this embodiment, the housing 5 is configured as an elongated hollow tube extending inwardly as depicted in FIG. 33, which is made of material with high heat-dissipating capability. The housing 5 is formed with a longitudinally extending V-shaped groove 50 on its wall. The groove 50 is sealed by a transparent plate 51.

A coolant fluid accommodating space 53 is defined in the housing 5 at the backside of the bottom of the groove and used to accommodate a coolant fluid 530. A thermally conductive member 64 extends downwardly from the bottom of the groove 50 into the coolant fluid accommodating space 53.

The light source module 6 comprises two mounting substrates 60, which are disposed back-to-back at opposite sides of the thermally conductive member 64, such that the respective mounting substrates 60 have an LED mounting surface facing a corresponding groove wall of the groove 50.

The light source module 6 further comprises a plurality of LEDs 61 operatively mounted on the mounting surfaces of the corresponding mounting substrates 60 in a manner electrically connected to a power source module (not shown), mounting electrodes (not shown) provided at both ends of the housing 5 as described in the embodiments above and adapted for directly coupling to a commercially available power socket, and a power source module (not shown) for converting mains power into a usable power source for the LEDs 61 as described in the embodiments above. In light of the arrangement disclosed herein, the working temperature of the LEDs 61 is effectively reduced by means of the provision of the thermally conductive member 64 and the coolant fluid 530.

The LEDs 61 are mounted on the mounting substrates 60 by any suitable means, such that the LEDs emit light towards corresponding groove walls of the groove 50. As a result, the light emitted from the LEDs 61 will exit from the housing 5 due to being reflected by the corresponding groove walls.

Figure 34:
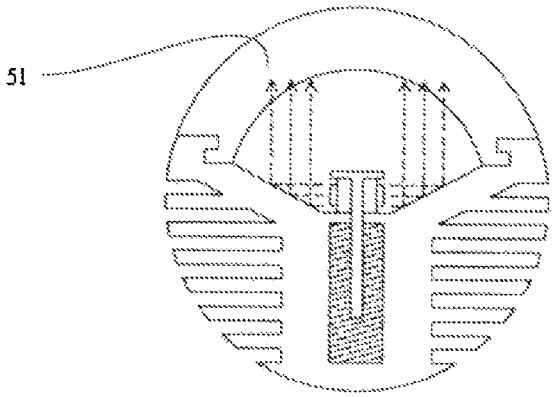
FIG. 34 is a schematic, cross-sectional view of an alternative example of the light-emitting diode illumination apparatus according to the twelfth preferred embodiment of the invention.

FIG. 34 is a schematic, cross-sectional view of an alternative example of the light-emitting diode illumination apparatus according to the twelfth preferred embodiment of the invention.

The arrangement shown in FIG. 34 differs from that shown in FIG. 33 in the shape of the transparent plate 51.

Figure 35:
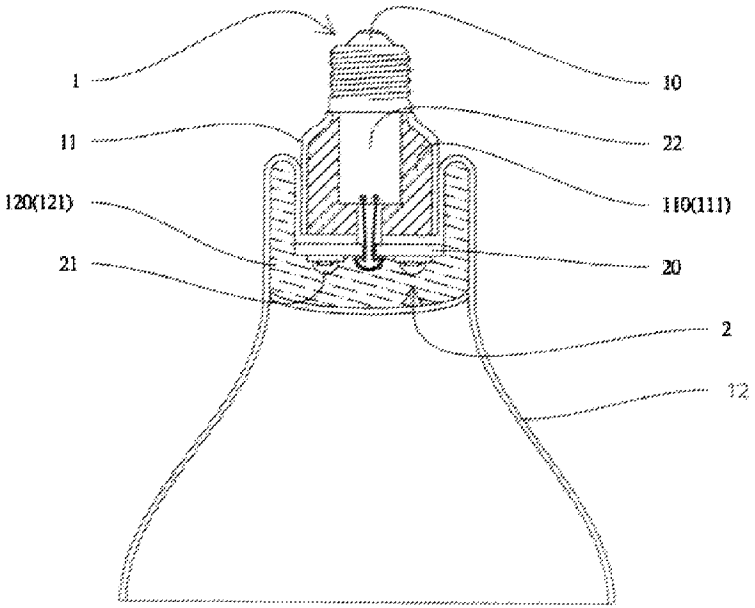
FIG. 35 is a schematic, cross-sectional view of the light-emitting diode illumination apparatus according to the thirteenth preferred embodiment of the invention.

FIG. 35 is a schematic, cross-sectional view of the light-emitting diode illumination apparatus according to the thirteenth preferred embodiment of the invention.

The LED illumination apparatus shown in FIG. 35 generally comprises a body 1 and a light source module 2.

In this embodiment, the body 1 has a lower portion 10 configured in the form of a standard E27-type threaded adapter and an upper portion 11 provided with a power source module accommodating chamber 110 for housing a power source module 22 of the light source module 2.

The body 1 further comprises a lamp cover 12 that sleeves over the upper portion 11 of the body 1. The lamp cover 12 includes a coolant fluid accommodating section 120 disposed adjacent to the upper portion 11 of the body 1, in which a coolant fluid 121 is filled.

The light source module 2 comprises a mounting substrate 20 disposed atop the upper portion 11 of the body 1 and within the coolant fluid accommodating section 120 of the lamp cover 12, at least one LED 21 operatively mounted on the mounting substrate 20 in a manner electrically connected to a power source module 22, and a power source module 22 disposed within the power source module accommodating chamber 110 of the body 1.

It should be noted that the power source module accommodating chamber 110 is filled with a sealing glue 111, so as to prevent the coolant fluid 121 from entering the power source module accommodating chamber 110. In addition, the LED 21 is mounted on the mounting substrate 20 by any suitable means.

Figure 36:
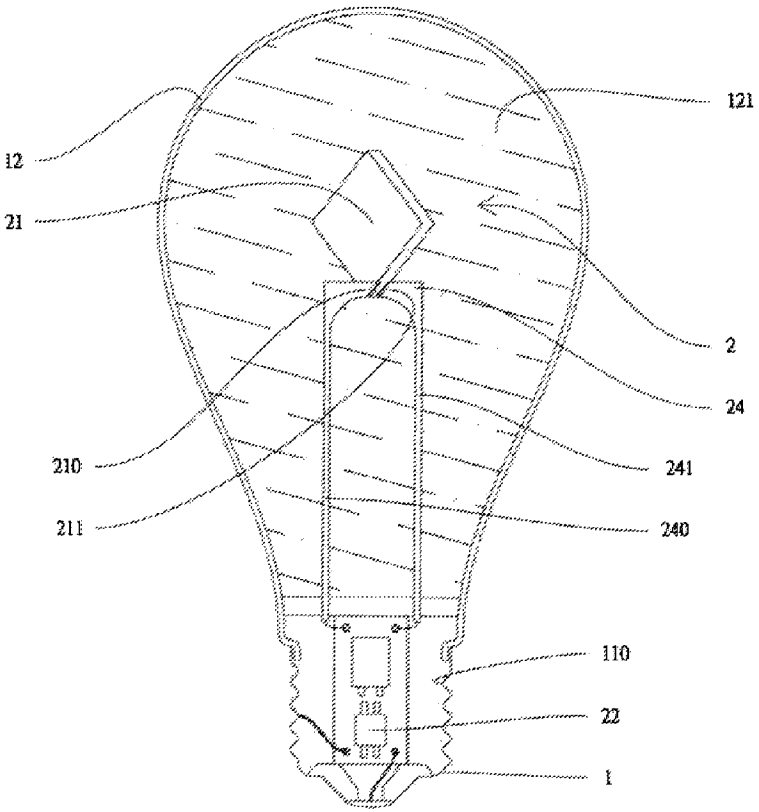
FIG. 36 is a schematic, cross-sectional view of the light-emitting diode illumination apparatus according to the fourteenth preferred embodiment of the invention.

FIG. 36 is a schematic, cross-sectional view of the light-emitting diode illumination apparatus according to the fourteenth preferred embodiment of the invention.

The LED illumination apparatus shown in FIG. 36 generally comprises a body 1 and a light source module 2.

In this embodiment, the body 1 is configured in the form of a standard E27-type threaded adapter and provided with a hermetically sealed power source module accommodating space 110 for housing a power source module 22 of the light source module 2.

The body 1 further comprises a lamp cover 12 disposed on an upper portion of the body 1. The lamp cover 12 can be configured in any shape and can be filled with an insulative coolant fluid 121.

The light source module 2 comprises a lead frame 24 disposed within the lamp cover 12, at least one LED 21 operatively mounted on the lead frame 24 to thereby be electrically connected to a power source module 22 via the lead frame 24, and a power source module 22 disposed within the power source module accommodating chamber 110 of the body 1.

The lead frame 24 includes two lead wires 240, 241, each having an end electrically connected to the power source module 22 disposed in the body 1 and an opposite end extending into the lamp cover 12.

The at least one LED 21 includes a first surface on which a first electrode 210 is mounted and a second surface on which a second electrode 211 is mounted. The first electrode 210 and the second electrode 211 are electrically connected to the corresponding lead wires 240, 241 of the lead frame 24, respectively, so that the at least one LED 21 is supported and secured in position by the lead wires 240, 241. By virtue of this arrangement, the light emitted from all of the six surfaces of the at least one LED 21 can be completely used for illumination.

It should be noted that the at least one LED 21 can be a single LED device or includes an array of LED devices electrically connected in series. If necessary, the first and second surfaces and the four side surfaces of the LED 21 can be formed with a phosphor powder layer (not shown).

Figure 37:
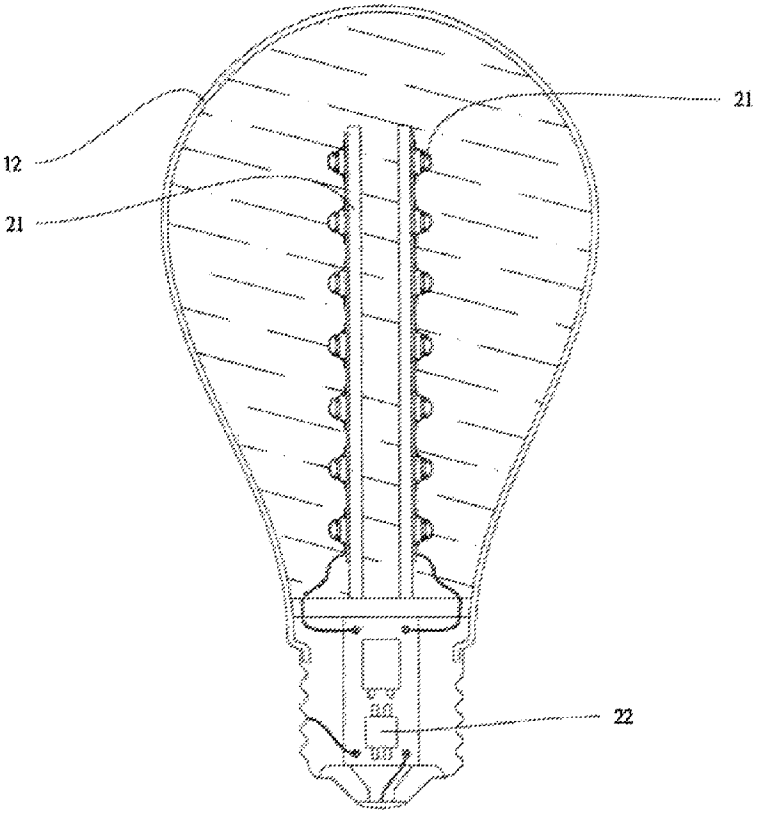
FIG. 37 is a schematic, cross-sectional view of an alternative example of the light-emitting diode illumination apparatus according to the fourteenth preferred embodiment of the invention.

FIG. 37 is a schematic, cross-sectional view of an alternative example of the light-emitting diode illumination apparatus according to the fourteenth preferred embodiment of the invention.

The embodiment shown in FIG. 37 differs from that of FIG. 36 in that the lead frame illustrated in FIG. 36 is replaced by instead providing two mounting substrates 20 extending upwardly from the upper portion of the body 1, and in that each of the mounting substrates 20 has a surface facing the lamp cover 12, on which a plurality of LEDs 21 are operatively mounted in a manner electrically connected to the power source module 22. The LEDs 21 are mounted on the mounting substrates 20 by any means suitable for mounting purpose, such as flip-chip bonding, chip-on-board bonding (COB) and the like.

Figure 38:
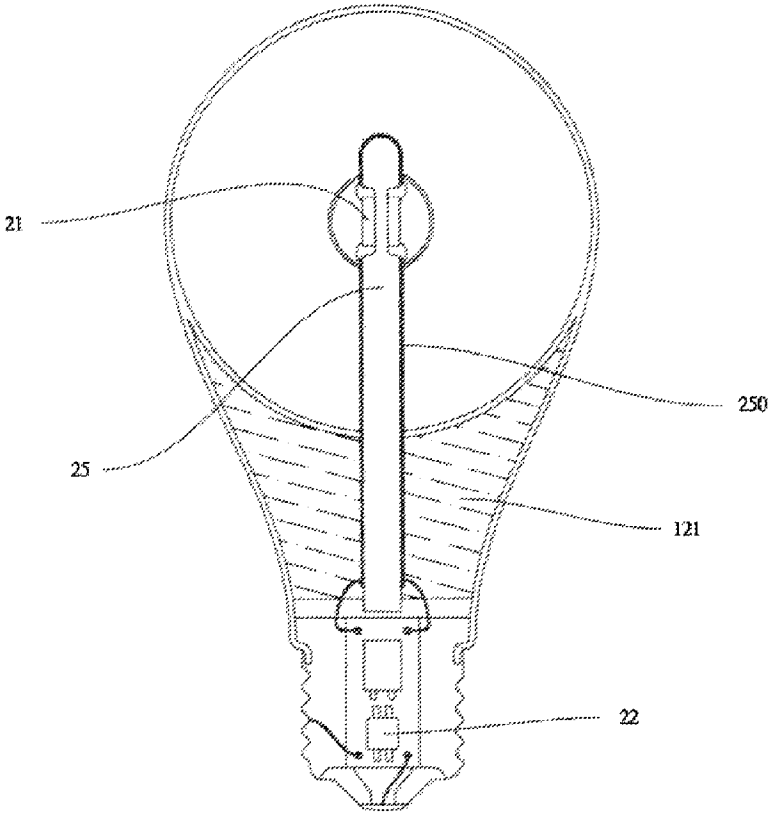
FIG. 38 is a schematic, cross-sectional view of another alternative example of the light-emitting diode illumination apparatus according to the fourteenth preferred embodiment of the invention.

FIG. 38 is a schematic, cross-sectional view of another alternative example of the light-emitting diode illumination apparatus according to the fourteenth preferred embodiment of the invention.

The embodiment shown in FIG. 38 differs from that of FIG. 36 in that the lead frame illustrated in FIG. 36 is replaced by instead providing a heat pipe 25 extending upwardly from the upper portion of the body 1, and in that the heat pipe 25 has a surface facing the lamp cover 12, on which predetermined circuit traces 250 are provided in a manner electrically connected to the power source module 22 and a plurality of LEDs 21 are operatively mounted in a manner electrically connected to the corresponding circuit traces 250. The LEDs 21 are mounted on the heat pipe 25 by any means suitable for mounting purpose, such as flip-chip bonding, chip-on-board bonding (COB) and the like.

In addition, a space adjacent to the body 1 is defined in the interior of the lamp cover 12, which does not accommodate any of the LEDs 21 but is filled with a coolant fluid 121, so as to enhance the performance of the heat pipe 25.

Figure 39:
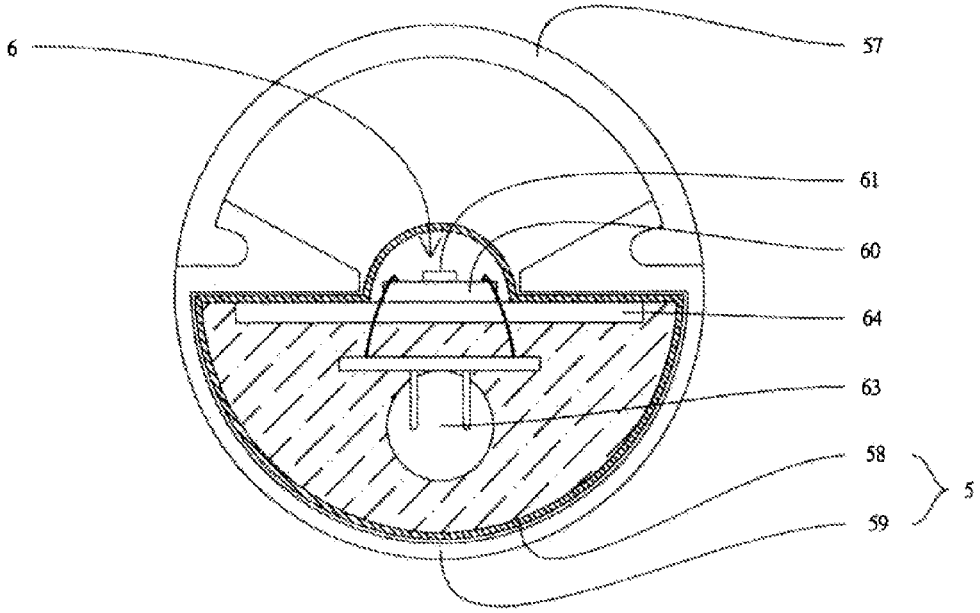
FIG. 39 is a schematic, cross-sectional view of the light-emitting diode illumination apparatus according to the fifteenth preferred embodiment of the invention.

FIG. 39 is a schematic, cross-sectional view of the light-emitting diode illumination apparatus according to the fifteenth preferred embodiment of the invention.

The LED illumination apparatus shown in FIG. 39 generally comprises a housing 5 and a light source module 6.

According to this embodiment, the housing 5 is configured as a generally semicylindrical-shaped, elongated hollow tube extending inwardly as depicted in FIG. 39 and composed of an outer tube 59 and an inner tube 58 sleeved within the outer tube 59. The outer tube 59 has a flat surface formed with a longitudinally extending elongated opening 50. The inner tube 58 has a flat surface formed with a longitudinally extending protruded portion protruded out through the opening 50 of the outer tube 59. The remaining space within the inner tube 58 other than the space where the protruded portion is positioned is filled up with a coolant fluid.

The light source module 6 comprises a longitudinally extending elongated bracket 64 disposed within the inner tube 58 at a position near the protruded portion, and a mounting substrate 60 disposed on the bracket 64 at a position between the bracket 64 and the protruded portion.

The light source module 6 further comprises a plurality of LEDs 61 operatively mounted on the mounting substrate 60 in a manner electrically connected to a power source module 63, mounting electrodes (not shown) provided at both ends of the housing 5 as shown in FIG. 17 and adapted for directly coupling to a commercially available power socket, and a power source module 63 for converting mains power into a usable power source for the LEDs 61.

It should be noted that the housing 5 further includes an arc-shaped transparent covering 57 which is integrated with the outer tube 59 to impart a cylindrical shape to the housing 5. Meanwhile, the LEDs 61 employed in this embodiment are not limited to that shown in FIG. 39, but include any type of LEDs disclosed or not disclosed herein.

Figure 40:
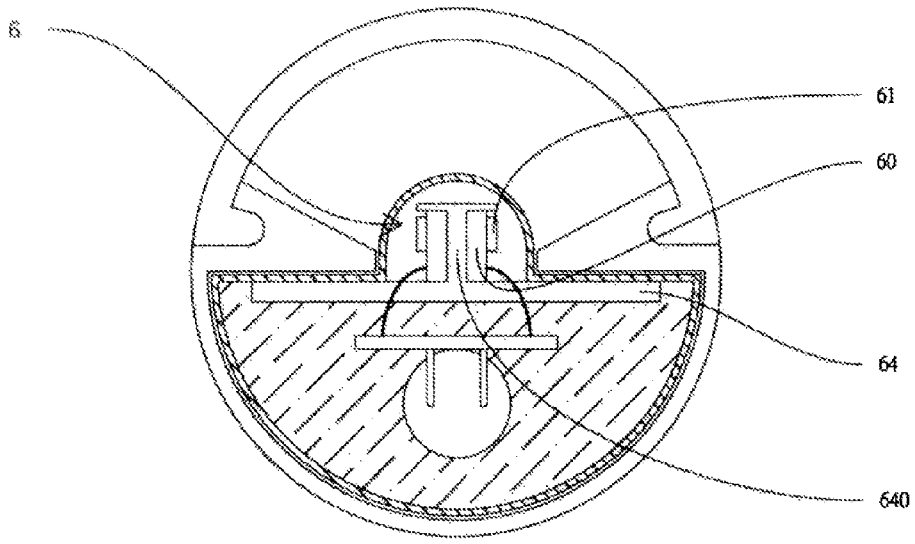
FIG. 40 is a schematic, cross-sectional view of an alternative example of the light-emitting diode illumination apparatus according to the fifteenth preferred embodiment of the invention.

FIG. 40 is a schematic, cross-sectional view of an alternative example of the light-emitting diode illumination apparatus according to the fifteenth preferred embodiment of the invention.

The embodiment shown in FIG. 40 differs from that of FIG. 39 in that the bracket 64 includes an upwardly erected mounting board 640, and in that mounting substrates 60 are disposed on both sides of the erected mounting board 640, on which the LEDs 61 of the light source module 6 are operatively mounted.

Figure 41B:
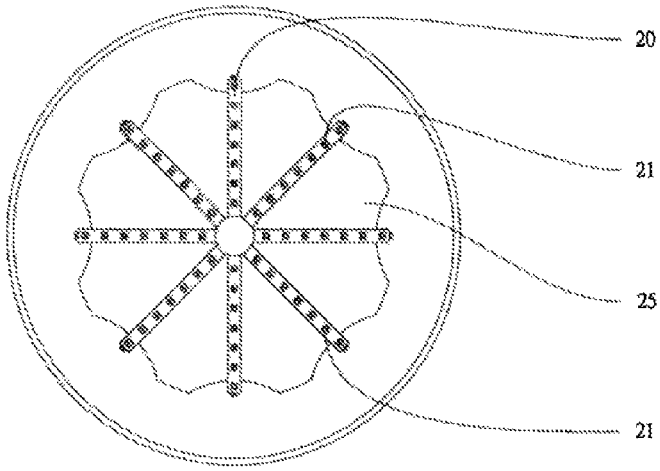
FIGS. 41A and 41B are schematic, cross-sectional views of the light-emitting diode illumination apparatus according to the sixteenth preferred embodiment of the invention.
Figure 41A:
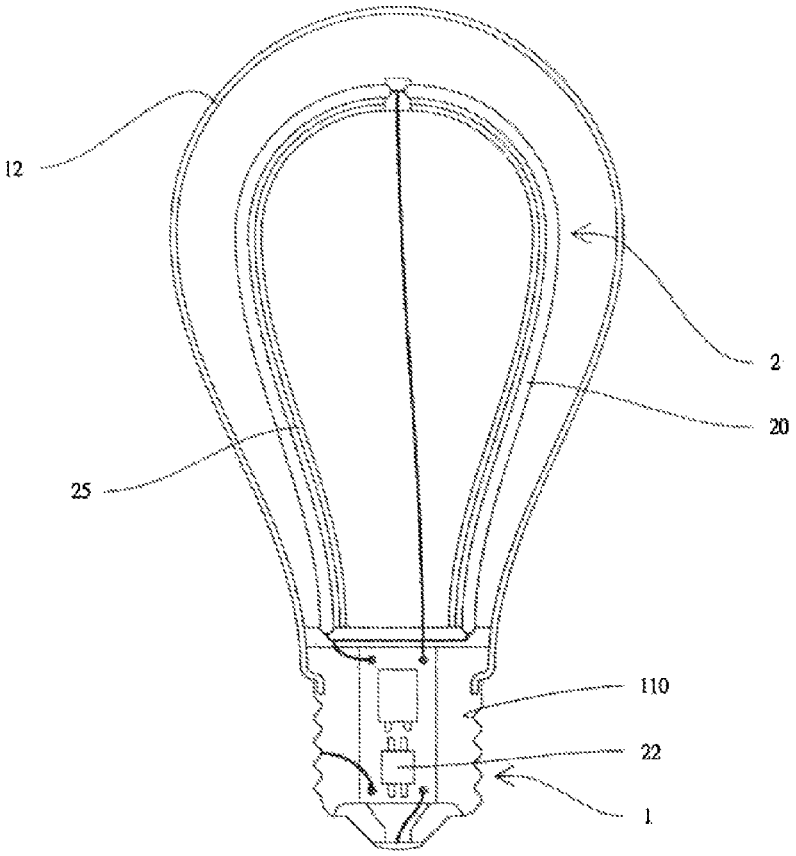

FIGS. 41A and 41B are schematic, cross-sectional views of the light-emitting diode illumination apparatus according to the sixteenth preferred embodiment of the invention.

The LED illumination apparatus shown in FIGS. 41A and 41B comprises a body 1 and a light source module 2.

In this embodiment, the body 1 is configured in the form of a standard E27-type threaded adapter and provided with a hermetically sealed power source module accommodating space 110 for housing a power source module of the light source module 2.

The body 1 further comprises a lamp cover 12 disposed at a top end of the body 1. The lamp cover 12 can be configured in any suitable shape and can be filled with an insulative coolant fluid.

The light source module 2 comprises a reflective frame 25 disposed within the lamp cover 12 and extending upwardly from the top end of the body 1, a plurality of mounting substrates 20 disposed on the reflective frame 25, a plurality of LEDs 21 operatively mounted on the mounting substrates 20, and a power source module 22 disposed within the power source module accommodating chamber 110 of the body 1.

Figure 42:
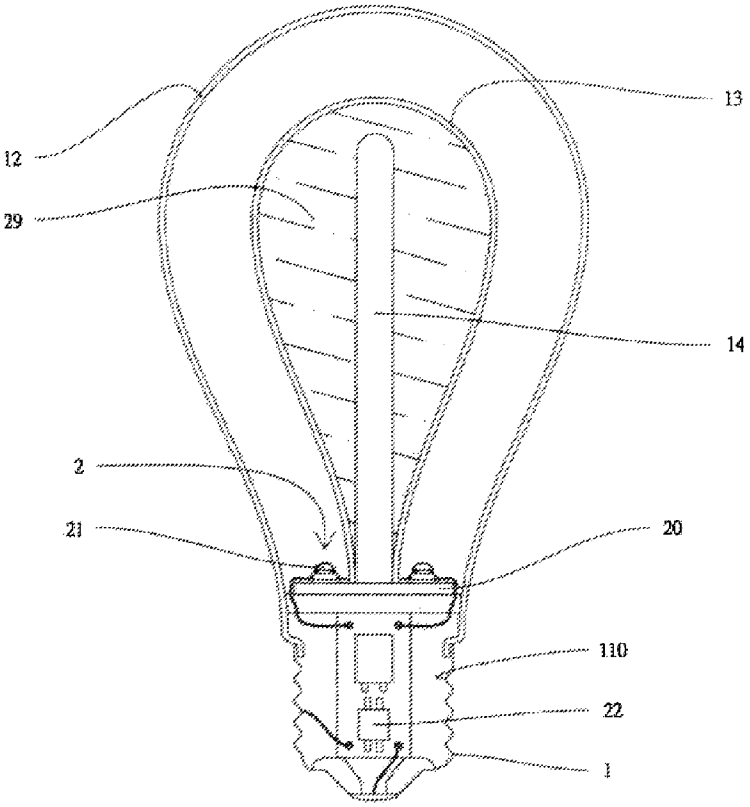
FIG. 42 is a schematic, cross-sectional view of the light-emitting diode illumination apparatus according to the seventeenth preferred embodiment of the invention.

FIG. 42 is a schematic, cross-sectional view of the light-emitting diode illumination apparatus according to the seventeenth preferred embodiment of the invention.

The LED illumination apparatus shown in FIG. 42 comprises a body 1 and a light source module 2.

In this embodiment, the body 1 is configured in the form of a standard E27-type threaded adapter and provided with a hermetically sealed power source module accommodating space 110 for housing a power source module of the light source module 2.

The body 1 further comprises a lamp cover 12 disposed at a top end of the body 1, a heat pipe 14 disposed within the lamp cover 12 and extending upwardly from the top end of the body 1, and a coolant fluid pack 13 disposed within the lamp cover 12 and sleeved around the heat pipe 14. The lamp cover 12 can be configured in any suitable shape, and the coolant fluid pack 13 is filled with a coolant fluid 29 to thereby enhance the heat-dissipating performance of the heat pipe 14.

The light source module 2 comprises a mounting substrate 20 disposed at the top end of the body 1 and within the lamp cover 12, a plurality of LEDs 21 operatively mounted on the mounting substrate 20, and a power source module 22 disposed within a power source module accommodating chamber 110 of the body 1.

Figure 43:
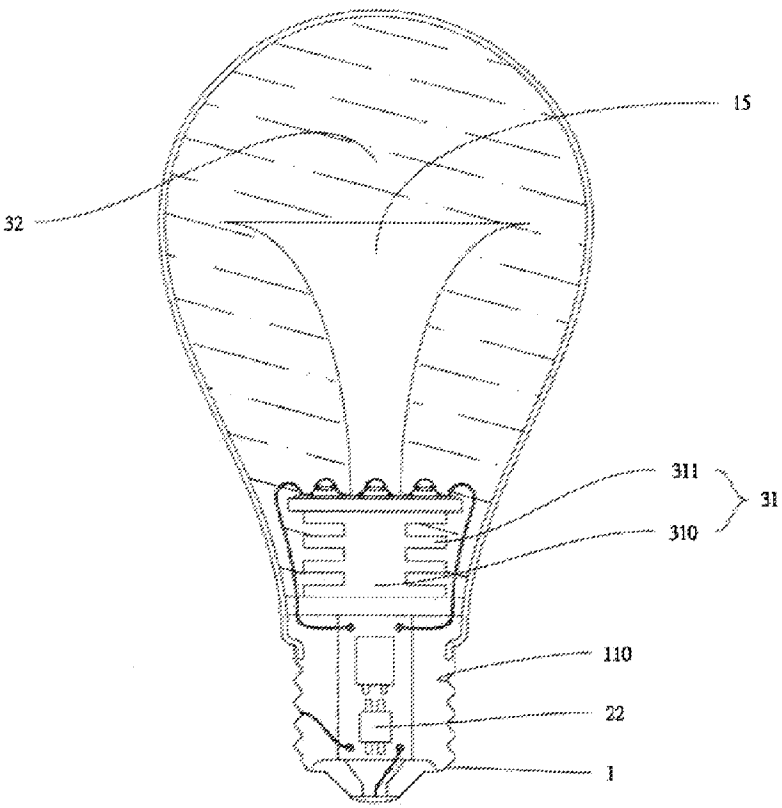
FIG. 43 is a schematic, cross-sectional view of the light-emitting diode illumination apparatus according to the eighteenth preferred embodiment of the invention.

FIG. 43 is a schematic, cross-sectional view of the light-emitting diode illumination apparatus according to the eighteenth preferred embodiment of the invention.

The LED illumination apparatus shown in FIG. 43 comprises a body 1 and a light source module 2.

In this embodiment, the body 1 is configured in the form of a standard E27-type threaded adapter and provided with a hermetically sealed power source module accommodating space 110 for housing a power source module 22 of the light source module 2.

A heat-dissipating member 31 includes a heat-dissipating body 310 disposed at a top end of the body 1 and a plurality of heat-dissipating fins 311 radially extending from the heat-dissipating body 310. A lamp cover 12 is disposed at the end of the body 1, so that the heat-dissipating member 31 is housed therein. The lamp cover 12 is adapted for being filled with a coolant fluid 32.

The light source module 2 comprises a mounting substrate 20 disposed on the heat-dissipating member 31, a plurality of LEDs 21 operatively mounted on the mounting substrate 20, and a power source module 22 disposed within a power source module accommodating chamber 110 of the body 1. The LEDs 21 are electrically connected to and receive power from the power source module 22.

A light diffusing member 15 extends upwardly from the heat-dissipating member 31 and spreads in a sectorial form along a direction away from the LEDs 21, so as to scatter the light emitted from the LEDs 21 out of the lamp cover 12.

Figure 44:
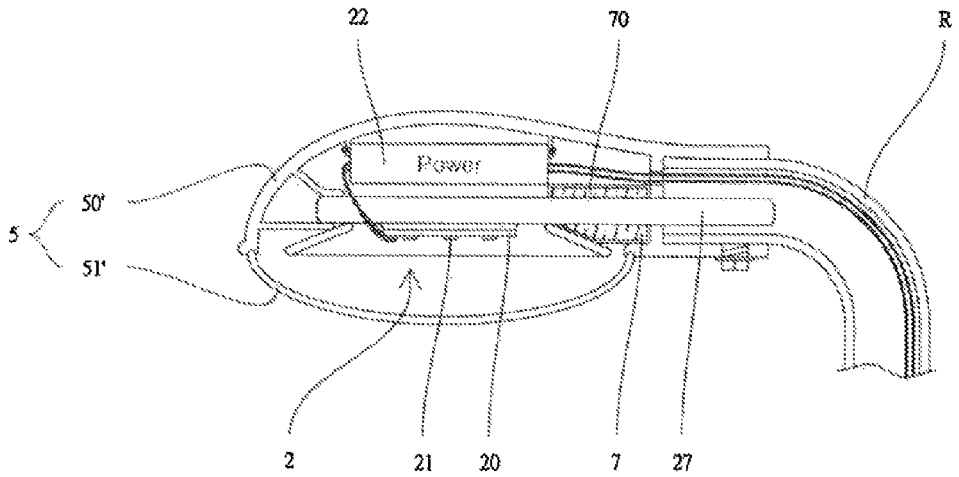
FIG. 44 is a schematic, cross-sectional view of the light-emitting diode illumination apparatus according to the nineteenth preferred embodiment of the invention.

FIG. 44 is a schematic, cross-sectional view of the light-emitting diode illumination apparatus according to the nineteenth preferred embodiment of the invention.

The LED illumination apparatus shown in FIG. 44 comprises a housing 5 and a light source module 2.

According to this embodiment, the housing 5 is configured in the form of a conventional street lamp cover composed of an upper half cover 50' and a lower half cover 51'. The housing 5 has a rear end adapted for coupling to a lamp holder R (only part of the lamp holder is shown), so that the housing 5 is fastened to the lamp holder. The lower half cover 51' includes a transparent portion allowing light to pass therethrough.

The light source module 2 comprises a heat pipe 27 fixed inside of the housing 5. The heat pipe 27 has a first end portion extending to the rear end of the housing 5 and a second end portion opposite to the first end portion. Amounting substrate 20 is disposed at the second end portion of the heat pipe 27, so that the mounting substrate 20 has a mounting surface facing the transparent portion of the lower half cover 51'. A plurality of LEDs 21 operatively mounted on the mounting surface of the mounting substrate 20. A power source module 22 is disposed within the upper half cover 50' of the housing 5 and adapted for converting mains power into a usable power source for the LEDs 21. A coolant fluid pack 7 filled with a coolant fluid 70 is disposed within the upper half cover 50' and sleeved around a portion of the heat pipe 27 between the first end portion and the second end portion, so as to enhance the heat-dissipating performance of the heat pipe 27.

Figure 45:
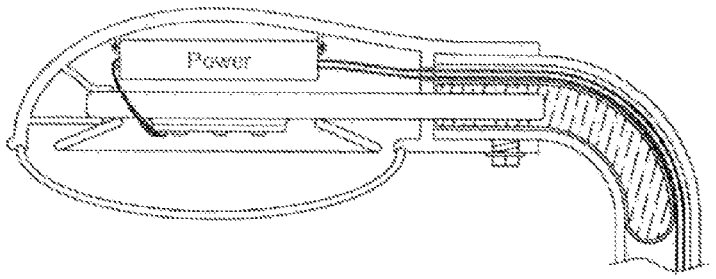
FIG. 45 is a schematic, cross-sectional view of an alternative example of the light-emitting diode illumination apparatus according to the nineteenth preferred embodiment of the invention.

FIG. 45 is a schematic, cross-sectional view of an alternative example of the light-emitting diode illumination apparatus according to the nineteenth preferred embodiment of the invention.

The embodiment shown in FIG. 45 differs from that of FIG. 44 in that the coolant fluid pack 7 is sleeved around the first end portion of the heat pipe 27.

Figure 46:
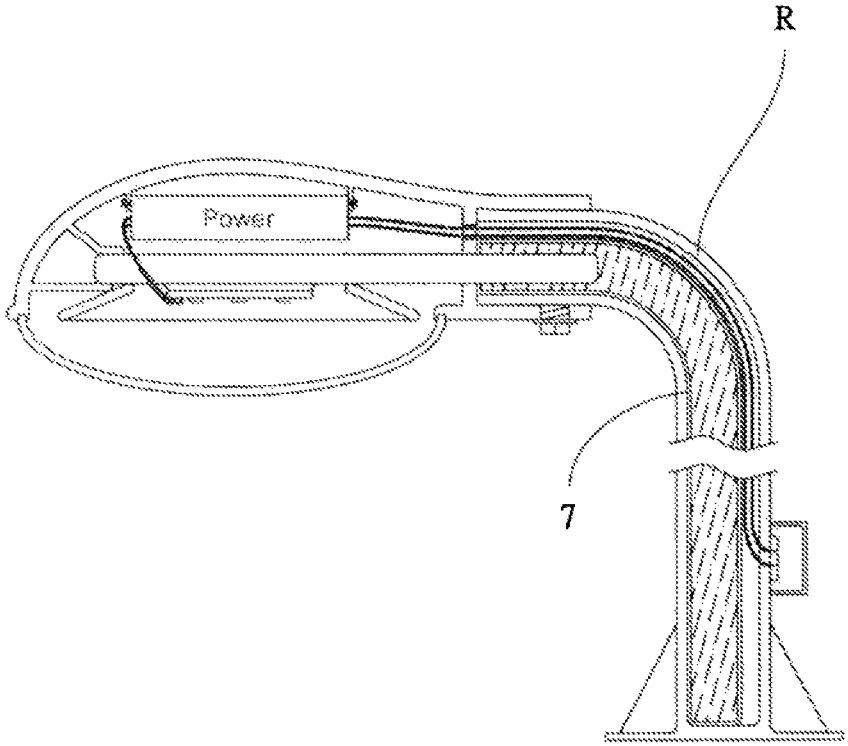
FIG. 46 is a schematic, cross-sectional view of another alternative example of the light-emitting diode illumination apparatus according to the nineteenth preferred embodiment of the invention.

FIG. 46 is a schematic, cross-sectional view of another alternative example of the light-emitting diode illumination apparatus according to the nineteenth preferred embodiment of the invention.

The embodiment shown in FIG. 46 differs from that of FIG. 44 in that the coolant fluid pack 7 is sleeved around the first end portion of the heat pipe 27 and extends to a bottom portion of the lamp holder R.

Figure 47:
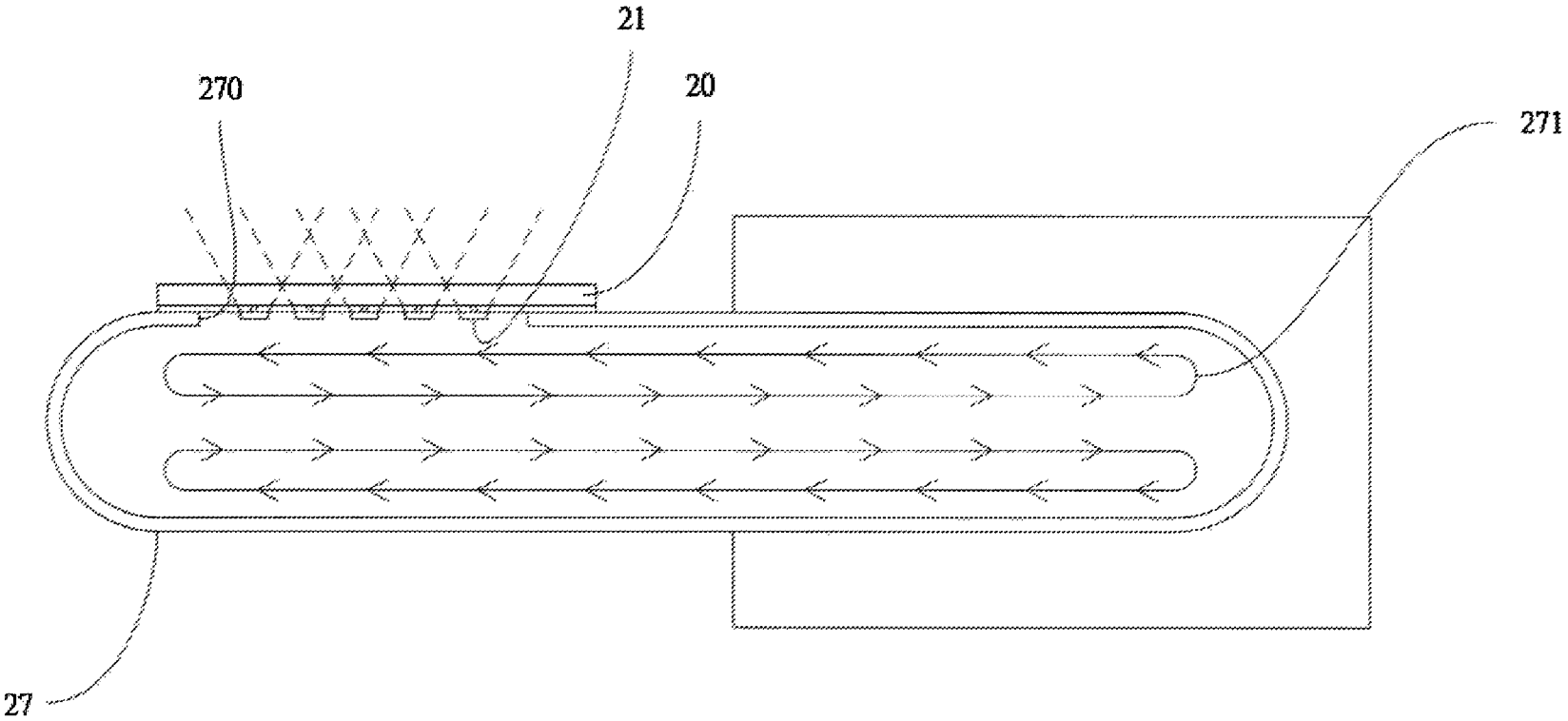
FIG. 47 is a schematic, cross-sectional view of still another alternative example of the light-emitting diode illumination apparatus according to the nineteenth preferred embodiment of the invention.

FIG. 47 is a schematic, cross-sectional view of still another alternative example of the light-emitting diode illumination apparatus according to the nineteenth preferred embodiment of the invention.

The embodiment shown in FIG. 47 differs from that of FIG. 44 in that the heat pipe 27 is processed by sintering and formed inside with a plurality of mini-channels 271 filled with a coolant fluid, and in that a via hole 270 is formed on a surface which resides in the second end portion of the heat pipe 27 and faces the lower half cover (not shown). In this embodiment, the mounting substrate 20 of the light source module is a transparent mounting substrate 20 secured on the second end portion of the heat pipe 27, so that the LEDs 21 mounted on the mounting surface of the mounting substrate 20 are present within the heat pipe 27. Therefore, during the operation of the LEDs 21, the emitted light will exit from the heat pipe 27 through the mounting substrate 20.

By virtue of the arrangement described above, the coolant fluid filled within the heat pipe 27 is circulated within the channels 271 (as indicated by the arrows) due to temperature rise during the operation of the LEDs 21, so as to enhance the heat-dissipating performance of the heat pipe 27.

In conclusion, the light-emitting diode illumination apparatuses as disclosed herein can surely achieve the intended objects and effects of the invention by virtue of the structural arrangements described above.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit of the invention and the scope thereof as defined in the appended claims.

What is claimed is:

1. A light-emitting diode illumination apparatus, comprising:

a body having a lower portion adapted for coupling to a commercially available power socket and an upper portion provided with a power source module accommodating chamber;

a heat-dissipating module including a funnel-shaped hollow case disposed at a top end of the upper portion of the body and filled with a coolant fluid, a flexible container disposed within the hollow case and used for accommodating the coolant fluid;

wherein the hollow case has a small diameter open end adjacent to the body and a large diameter open end remote from the body and having a greater diameter than that of the small diameter open end; and a light source module including a mounting substrate disposed at the small diameter open end, at least one light-emitting diode (LED) operatively mounted on the mounting substrate, and a power source module disposed within the power source module accommodating chamber of the body in a manner electrically connected to and supplying working power to the LED.

2. The LED illumination apparatus according to claim 1, wherein the hollow case is provided at the small diameter open end with a heat-dissipating member, which includes a heat-dissipating body and a plurality of heat-dissipating fins radially extending from the heat-dissipating body to the case in a manner contacting with coolant fluid filled within the case, and wherein the mounting substrate is disposed on the heat-dissipating member.

3. The LED illumination apparatus according to claim 1, wherein the light source module further comprises a transparent protective shield for housing the mounting substrate.

4. The LED illumination apparatus according to claim 3, further comprising a lens for sealing the large diameter open end of the hollow case, and a phosphor powder layer coated on an inner surface or an outer surface of the lens, or on an inner surface or an outer surface of the protective shield, or on the mounting substrate in a manner covering the LED mounted on the mounting substrate.

5. The LED illumination apparatus according to claim 1, wherein the mounting substrate is erectedly disposed and includes two mounting surfaces on which the LED is operatively mounted in a manner electrically connected to the power source module.

6. A light-emitting diode illumination apparatus, comprising:

a body having a lower portion adapted for coupling to a commercially available power socket and an upper portion provided with a power source module accommodating chamber;

a heat-dissipating module including a lamp cover provided at a top end of the upper portion of the body and a coolant fluid filled within the lamp cover;

a light source module including a mounting substrate disposed within the lamp cover, at least one LED operatively mounted on the mounting substrate, and a power source module disposed within the power source module accommodating chamber of the body in a manner electrically connected to and supplying working power to the LED;

a heat-dissipating member and a transparent protective shield, wherein the heat-dissipating member includes a heat-dissipating body disposed at a top end of the upper portion of the body and a plurality of heat-dissipating fins radially extending from the heat-dissipating body, and wherein the transparent protective shield houses the mounting substrate; and a phosphor powder layer coated on an inner surface or an outer surface of the transparent protective shield, or on an inner surface or an outer surface of the lamp cover, or on the mounting substrate in a manner covering the LED mounted on the mounting substrate.

7. A light-emitting diode illumination apparatus, comprising:

a body having a lower portion adapted for coupling to a commercially available power socket and an upper portion;

a heat-dissipating module including at least one heat-dissipating fin set disposed in an array configuration within the upper portion of the body, and at least one heat pipe, wherein the heat-dissipating fin set includes a hollow tubular body and a plurality of heat-dissipating fins radially extending from the hollow tubular body, and wherein the heat pipe is disposed within the body of the heat-dissipating fin set and protruded at both ends thereof from the body of the heat-dissipating fin set; and a light source module comprising a mounting substrate disposed at one end of the upper portion of the body, at least one LED, and a power source module disposed within the body and adapted for converting mains power into a usable power source for the LED, wherein the mounting substrate is formed with a through hole at a position corresponding to the heat pipe, so as to allow the heat pipe to be inserted at its end into the through hole, and wherein the LED is operatively mounted at the one end of the heat pipe that penetrates through the through hole of the mounting substrate.

8. The LED illumination apparatus according to claim 7, wherein the light source module further comprises a transparent protective shield that serves as a lamp cover, wherein the protective shield is disposed on the upper portion of the body in a manner covering over the mounting substrate, so as to protect the LED from external damage, and wherein the protective shield is filled with an insulative coolant fluid to reduce the working temperature of the LED.

9. The LED illumination apparatus according to claim 7, wherein the upper portion of the body is provided with a coolant fluid accommodating section, in which a coolant fluid is filled, and wherein the heat pipe is arranged to traverse across the coolant fluid accommodating section, so as to enhance the heat transfer performance of the heat pipe.

10. The LED illumination apparatus according to claim 7, wherein the heat pipe is composed of first to fourth heat pipe portions, wherein the first heat pipe portion of the heat pipe has a first end at which the LED is mounted, wherein the second heat pipe portion of the heat pipe comprises two heat pipes disposed at both sides of the second end of the first heat pipe portion opposite to the first end, wherein the third heat pipe portion of the heat pipe comprises four heat pipes disposed at both sides of the corresponding ends of the second heat pipe portion distal to the first heat pipe portion, and wherein the fourth heat pipe portion of the heat pipe comprises eight heat pipes disposed at both sides of the corresponding ends of the third heat pipe portion distal to the second heat pipe portion.

11. A light-emitting diode illumination apparatus, comprising:

a body adapted for coupling to a commercially available power socket and provided with a power source module accommodating chamber, and a lamp cover disposed on an upper portion of the body, wherein the lamp cover includes a coolant fluid accommodating section disposed adjacent to the upper portion of the body, in which a coolant fluid is filled; and a light source module comprising a mounting substrate disposed within the accommodating section of the lamp cover, at least one LED operatively mounted on the mounting substrate, and a power source module disposed within the power source module accommodating chamber of the body and electrically connected to the LED and adapted for converting mains power into a usable power source for the LED.

12. The LED illumination apparatus according to claim 11, wherein the power source module accommodating chamber is filled with a sealing glue, so as to prevent the coolant fluid from entering the power source module accommodating chamber.

13. A light-emitting diode illumination apparatus, comprising:

a body adapted for coupling to a commercially available power socket and provided with a power source module accommodating chamber, and a lamp cover disposed on an upper portion of the body and filled with a coolant fluid; and a light source module comprising a lead frame disposed within the lamp cover, at least one LED operatively mounted on the lead frame, and a power source module disposed within the power source module accommodating chamber of the body and electrically connected to the LED via the lead frame and adapted for converting mains power into a usable power source for the LED wherein the lead frame includes two lead wires extending upwardly from the body, and wherein the at least one LED includes a first surface on which a first electrode is mounted and a second surface on which a second electrode is mounted, the first electrode and the second electrode being electrically connected to the corresponding lead wires of the lead frame, respectively, so that the at least one LED is supported and secured in position by the lead wires, whereby the light emitted from all six surfaces of the at least one LED can be completely used for illumination.

14. A light-emitting diode illumination apparatus, comprising:

a body adapted for coupling to a commercially available power socket and provided with a power source module accommodating chamber, and a lamp cover disposed on an upper portion of the body and filled with a coolant fluid; and a light source module comprising at least one heat pipe extending upwardly from the upper portion of the body, predetermined circuit traces overlaid on a surface of the heat pipe, at least one LED operatively mounted on the surface of the heat pipe in a manner electrically connected to the predetermined circuit traces, and a power source module disposed within the power source module accommodating chamber of the body and electrically connected to the predetermined circuit traces and adapted for converting mains power into a usable power source for the LED.

15. A light-emitting diode illumination apparatus, comprising:

a body adapted for coupling to a commercially available power socket and provided with a power source module accommodating chamber, a lamp cover disposed at a top end of the body, a heat pipe disposed within the lamp cover and extending upwardly from the top end of the body, and a coolant fluid pack disposed within the lamp cover and sleeved around the heat pipe and filled with a coolant fluid; and a light source module comprising a mounting substrate disposed at the top end of the body and within the lamp cover, at least one LED operatively mounted on the mounting substrate, and a power source module disposed within the power source module accommodating chamber of the body and electrically connected to the LED and adapted for converting mains power into a usable power source for the LED.

16. A light-emitting diode illumination apparatus, comprising:

a body having a lower portion adapted for coupling to a commercially available power socket and an upper portion provided with a power source module accommodating chamber;

a heat-dissipating module including a funnel-shaped hollow case disposed at a top end of the upper portion of the body and filled with a coolant fluid, wherein the hollow case has a small diameter open end adjacent to the body and a large diameter open end remote from the body and having a greater diameter than that of the small diameter open end;

a light source module including a mounting substrate disposed at the small diameter open end, at least one light-emitting diode (LED) operatively mounted on the mounting substrate, a transparent protective shield for housing the mounting substrate, and a power source module disposed within the power source module accommodating chamber of the body in a manner electrically connected to and supplying working power to the LED; and a lens for sealing the large diameter open end of the hollow case, and a phosphor powder layer coated on an inner surface or an outer surface of the lens, or on an inner surface or an outer surface of the protective shield, or on the mounting substrate in a manner covering the LED mounted on the mounting substrate.

* * * * *